US006263844B1

(12) United States Patent
Ozeki et al.

(10) Patent No.: US 6,263,844 B1
(45) Date of Patent: Jul. 24, 2001

(54) OIL PASSAGE FOR INTERNAL COMBUSTION ENGINE

(75) Inventors: Hisashi Ozeki; Kentaro Kondo, both of Shizuoka-ken (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 09/473,884

(22) Filed: Dec. 28, 1999

(30) Foreign Application Priority Data

Dec. 29, 1998 (JP) ..... 10-377541

(51) Int. Cl.[7] ..... F01M 1/06; F01M 9/10

(52) U.S. Cl. ..... 123/90.17; 123/90.34; 123/90.38; 123/196 R; 123/196 M; 184/6.5

(58) Field of Search ..... 123/90.15, 90.17, 123/90.31, 90.33, 90.34, 90.38, 196 R, 196 M; 184/6.5

(56) References Cited

U.S. PATENT DOCUMENTS

| | | | | |
|---|---|---|---|---|
| 5,301,639 | * | 4/1994 | Satou | 123/90.17 |
| 5,353,755 | * | 10/1994 | Matsuo et al. | 123/90.13 |
| 5,474,038 | * | 12/1995 | Golovatai-Schmidt et al. | 123/90.17 |
| 5,988,126 | * | 11/1999 | Strauss et al. | 123/90.17 |
| 6,035,817 | * | 3/2000 | Uchida | 123/90.17 |

FOREIGN PATENT DOCUMENTS

| | | |
|---|---|---|
| 62-179314 | 11/1987 | (JP) . |
| 5-6112 | 1/1993 | (JP) . |
| 5-71315 | 3/1993 | (JP) . |
| 5-288022 | 11/1993 | (JP) . |
| 6-159020 | 6/1994 | (JP) . |
| 6-212918 | 8/1994 | (JP) . |
| 6-317113 | 11/1994 | (JP) . |
| 7-166831 | 6/1995 | (JP) . |
| 8-28231 | 1/1996 | (JP) . |
| 8-100611 | 4/1996 | (JP) . |
| 8-232625 | 9/1996 | (JP) . |
| 9-170415 | 6/1997 | (JP) . |
| 9-170416 | 6/1997 | (JP) . |
| 9-222008 | 8/1997 | (JP) . |
| 9-280014 | 10/1997 | (JP) . |
| 9-317412 | 12/1997 | (JP) . |
| 10-8987 | 1/1998 | (JP) . |
| 10-8988 | 1/1998 | (JP) . |
| 10-121918 | 5/1998 | (JP) . |
| 10-184331 | 7/1998 | (JP) . |

* cited by examiner

*Primary Examiner*—Weilun Lo
(74) *Attorney, Agent, or Firm*—Flynn, Thiel, Boutell & Tanis, P.C.

(57) ABSTRACT

An oil passage for an internal combustion engine having a timing chain entrained around a crank sprocket and a cam sprocket, the crank sprocket being mounted on a crankshaft of the engine, and the cam sprocket being positioned on a camshaft. A timing case is disposed on one side of the engine for enclosing the timing chain. The oil passage for supplying the engine oil to the actuator is connected at an upstream side thereof to a downstream side of an oil pump, while a downstream side of the oil passage is positioned inside the timing case and around the cam sprocket.

7 Claims, 24 Drawing Sheets

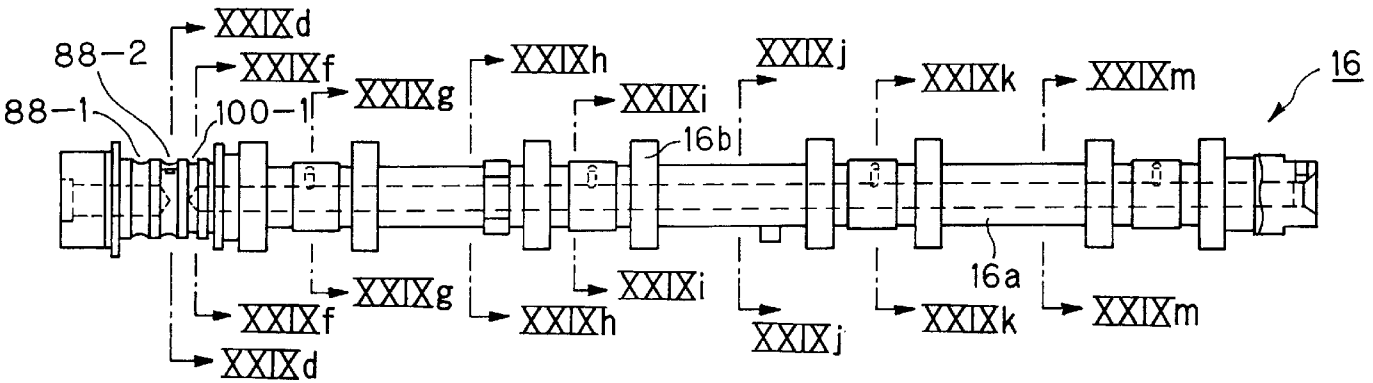
FIG. 29(a)
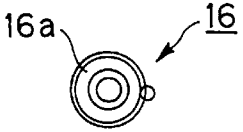
FIG. 29(e)
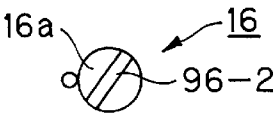
FIG. 29(d)
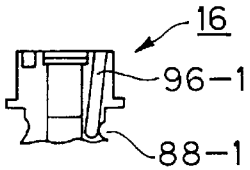
FIG. 29(c)
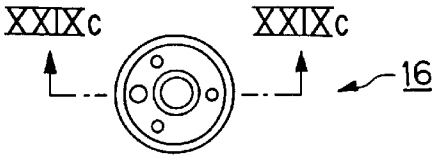
FIG. 29(b)
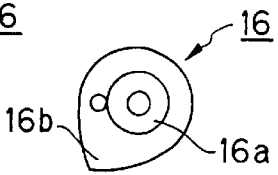
FIG. 29(m)
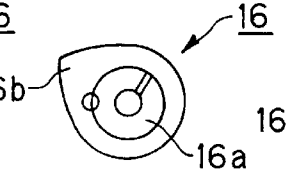
FIG. 29(k)
FIG. 29(j)
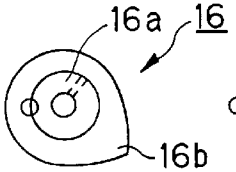
FIG. 29(i)
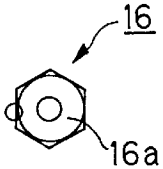
FIG. 29(h)
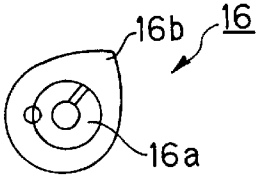
FIG. 29(g)
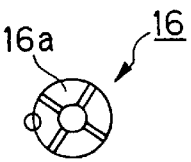
FIG. 29(f)

OIL PASSAGE FOR INTERNAL COMBUSTION ENGINE

FIELD OF THE INVENTION

This invention relates-to an oil passage for an internal combustion engine and, more particularly, to an oil passage for an internal combustion engine in which the oil passage is not provided in components such as a cylinder block or a cylinder head as produced by large-scaled facilities, but is provided using components fabricated by small-scaled facilities or small-sized components, and thus manufacturing facilities can be changed at small costs when an existing internal combustion engine is utilized so as to meet technical specifications requiring a different or variable valve timing actuator, whereby a low cost internal combustion engine designed for the valve timing actuator is achievable.

BACKGROUND OF THE INVENTION

An oil passage provided in an internal combustion engine is classed as an oil passage adapted for lubrication and cooling, an oil passage designed for drive, and the like. The former passage supplies engine oil from an oil pan to lubricated sections by an oil pump drawing the engine oil upward from the oil pan. The latter oil passage supplies the engine oil as drive pressure to a variable valve timing actuator. The actuator is disposed on one side of a camshaft.

The oil passage designed for drive is communicated to a main oil gallery of the engine in order to permit the engine oil in the main gallery to be guided into the actuator, thereby adjusting valve timing toward spark advance or delay.

One such example of an oil passage is disclosed in published Japanese Patent Application Laid-Open No. 5-288022. In a device for supplying working oil to a variable valve timing mechanism for an engine as disclosed therein, the working oil is supplied to the mechanism through an oil passage in a camshaft from one of the journal portions of the camshaft, which journal portion is positioned between a journal portion at an end of the camshaft and a central portion of the camshaft in an axial direction thereof. The device supplies the working oil to the variable valve timing mechanism in a stable manner, and the mechanism thereby provides improved response.

Another example of the oil passage is disclosed in published Japanese Patent Application Laid-Open No. 6-159020. In a valve timing adjuster as disclosed therein, even when communication between a source of oil pressure and first and second annular grooves is cut off, oil from a journal-lubricating passage permits lubrication between a cam journal portion and a bearing portion to be always retained in a good condition. In addition, the oil leaking from the journal-lubricating passage is supplied substantially evenly to the first and second annular grooves. As a result, the valve timing adjuster is always actuated in an invariable manner.

A further example of the oil passage is disclosed in published Japanese Patent Application Laid-Open No. 6-317113. In a valve-driving mechanism for an engine as disclosed therein, a cylinder head is formed with a head-side hydraulic passage for communicating an opening of an in-shaft hydraulic passage with a block-side hydraulic passage. The block-side hydraulic passage is formed in a cylinder block. In addition, there is formed a lubricating oil passage that is communicated to a journal portion. The lubricating oil passage is branched off from the head-side hydraulic passage. Further, the head-side hydraulic passage has a changeover valve provided at the branch portion thereof, but displaced toward the journal portion. The changeover valve interrupts a supply of hydraulic pressure. As a result, there is provided improved response to switching of valve timing.

A yet further example of the oil passage is disclosed in published Japanese Patent Application Laid-Open No. 7-166831. In a camshaft-lubricating device for an internal combustion engine as disclosed therein, there are provided a lubricating oil supply hole and a branch passage in order to reliably lubricate respective camshaft bearing surfaces, thereby preventing seizing thereof. The lubricating oil supply hole is communicated to a main oil gallery in a cylinder head. In addition, the supply hole is open to a surface where a camshaft bearing portion and a cam bracket are jointed together. The branch passage is formed along the joint surface between the camshaft bearing portion and the cam bracket. In addition, a distal end of the branch passage is bifurcated so as to be open to the opposite camshaft bearing surfaces, with a peripheral groove being sandwiched therebetween. Further, the branch passage is communicated to the lubricating oil supply hole. The camshaft bearing surfaces are two surfaces divided by the peripheral groove that is formed in a cam journal.

Still another example of the oil passage is disclosed in published Japanese Patent Application Laid-Open No. 9-170415. In an oil passage structure for an internal combustion engine as disclosed therein, an oil passage is laid out compactly in a small space without any changes in position and size of a cam cap bolt.

A yet further example of the oil passage is disclosed in published Japanese Patent Application Laid-Out No. 9-170416. In an oil passage structure for an internal combustion engine as disclosed therein, one oil passage designed for control and another designed for lubrication are rationally arranged in order to form a compact internal combustion engine having a reduced transverse width and a reduced entire length.

Another example of the oil passage is disclosed in published Japanese Patent Application Laid-Open No. 9-222008. In an engine having a lubrication device provided therein as disclosed therein, oil is supplied to first and second tensioners branched off from a main gallery, independently of a system of oil supply to a valve-driving mechanism. There is provided a reduced length of oil supply, which reaches a bearing portion of the second tensioner. In particular, when the engine is started up, there is provided improved response of oil supply to the bearing portions of the second tensioner. In addition, a simplified path of oil supply is provided.

A further example of the oil passage is disclosed in published Japanese Patent Application Laid-Open No. 9-280014. In a valve-driving camshaft structure as disclosed therein, a camshaft has an oil hole provided therein along the axis of the camshaft at a portion extending between a distal end of a bolt and a threaded portion of the bolt. An elongated bore portion is provided at the distal end of the bolt. The elongated bore portion corresponds to the above oil hole. A space between the elongated bore portion and an inner wall of the oil hole of the camshaft is formed as one oil passage. In addition, an intermediate hole provided at a central portion of the bolt along the axis of the bolt is formed as another oil passage. Thus, a compact structure with improved strength is realized.

A still further example of the oil passage is disclosed in published Japanese Patent Application Laid-Open No. 10-8987. In a chain cover structure for a four-cycle engine as disclosed therein, the entire chain cover is formed as a member separate from a cylinder head. The chain cover is formed integrally with a mounting portion, on which an oil supply portion for a valve timing variable device is mounted. As a result, improved operability is obtained when a chain guide and the like is built on the chain cover.

A yet further example of the oil passage is disclosed in published Japanese Patent Application Laid-Open No. 10-8988. In a four-cycle engine having a variable valve timing device as disclosed therein, the variable valve timing device is disposed on one camshaft for changing phase angle between a cam sprocket and the other camshaft in response to a variation in hydraulic pressure that acts on an oil housing body through an oil control solenoid valve. The oil housing body attached to the aforesaid one camshaft is positioned outward in the direction of the camshaft from a primary sprocket of the other camshaft. One of intake-side valve timing and exhaust-side valve timing is independently controllable. A spacing between the respective axes of intake and exhaust camshafts is reduced, thereby providing a compact cylinder head as well as a compact combustion chamber.

Still another example of the oil passage is disclosed in published Japanese Patent Application Laid-Open No. 10-121918. In a valve characteristic control device for an internal combustion engine as disclosed therein, a restricting means is provided around a discharge hole of a drain passage for restricting a mixed inflow of oil other than oil to be discharged into a deoiling portion. As a result, a valve characteristic variation mechanism ensures enhanced actuation response.

FIGS. 34 and 35 illustrate a conventional oil passage for the engine, in which an internal combustion engine 402 has a variable valve timing (also referred to as "VVT") actuator 456 positioned on one side of an intake-side camshaft 416. Referring to FIG. 35, a machined oil passage 458 is shown provided in either cylinder head 406 or cylinder block 404 for supplying oil to the actuator 456.

When a VVT-dedicated oil passage as previously mentioned is provided in the cylinder head or block of the existing engine, which is not designed for the above actuator, then related facilities in very large casting facilities and machining facilities must be changed. Such changes in facilities bring about an inconvenience of associated high costs, which is disadvantageous from an economic viewpoint.

FIGS. 36 and 37 disclose an optimum engine for description of problems to be solved. A second oil pipe for supplying the oil to the actuator is mounted on a cam housing 468 at a position above the intake-side camshaft between two cam housing bolts. As shown in FIG. 37, a breather chamber 478 is formed inside a cylinder head cover 410. The cylinder head cover 410 has an inwardly protruding relief portion 476 formed therein so as to avoid the position where the second oil pipe 470 is mounted on the cam housing 468. As a result, as seen from FIG. 37, the breather chamber 478 has a passage of small width "W1", and an oil mist flows through such a narrow passage at an increased velocity of flow. This causes another inconvenience that the oil-separating performance of the breather chamber is degraded, which is disadvantageous in view of practical use.

A further inconvenience arises from a construction in which the second oil pipe is positioned over a timing chain extending between intake-side and exhaust-side cam sprockets. More specifically, when the timing chain is swung, then there is a likelihood that the timing chain bumps against the second oil pipe, and that the second oil pipe is thereby damaged.

Further, when the second oil pipe is formed by two oil pipes different in length in which one is an advance-side second oil pipe while the other is a delay-side second oil pipe, then the longer pipe is employed as the advance-side second oil pipe. The advance-side second oil pipe uses the rear side of an oil groove that is provided in the camshaft.

When ignition timing is advanced, the variable valve timing actuator requires greater energy than when the ignition timing is delayed. As a result, the advance-side second oil pipe suffers from an increased loss of pressure when the ignition timing is advanced. This causes another inconvenience that the actuator is actuated for an increased period of time, which is disadvantageous in view of practical use.

In order to obviate or minimize the above inconveniences, the present invention provides an oil passage for an internal combustion engine, having a cylinder head attached to the top of a cylinder block and an oil pan fitted to the bottom of the cylinder block, the oil passage supplying engine oil to lubricated sections by an oil pump pumping the engine oil up from the oil pan, the oil passage using the engine oil as drive pressure on a variable valve timing actuator, the actuator being disposed on one side of a camshaft, comprising: a timing chain entrained around a crank sprocket and a cam sprocket, the crank sprocket being mounted on a crankshaft of the engine, the cam sprocket being positioned on the camshaft; and, a timing case disposed on one side of the engine for enclosing the timing chain; wherein the oil passage for supplying the engine oil to the actuator is connected at an upstream side thereof to a downstream side of the oil pump, while a downstream side of the oil passage is positioned inside the timing case and around the cam sprocket.

Pursuant to the above-described invention, the upstream side of the oil passage is connected to the downstream side of the oil pump, while the downstream side of the oil passage is located inside the timing case and around the cam sprocket. The oil passage is not provided in components produced by large-scaled facilities such as the cylinder block or head, but is provided using components fabricated by small-scaled facilities or small-sized components. Thus, manufacturing facilities are changed at small costs when an existing internal combustion engine is utilized so as to meet technical specifications of the actuator. As a result, a low cost internal combustion engine designed for the actuator is realized.

BRIEF DESCRIPTION OF THE DRAWINGS

FIG. 25 (*b*) is a view taken along arrow XXV*b* in FIG. 25 (*a*);

FIG. 28 (*b*) is a front view showing the cam housing;

FIG. 28 (*c*) is a right side view illustrating the cam housing;

FIG. 28 (*d*) is a rear view illustrating the cam housing;

FIG. 28 (*e*) is a cross-sectional view taken along line XXVIIIe—XXVIIIe in FIG. 28 (*b*), showing the cam housing;

FIG. 28 (*f*) is a cross-sectional view taken along line XXVIIIf—XXVIIIf in FIG. 28 (*d*), illustrating the cam housing;

FIG. 29 (*a*) is a front view illustrating an intake-side camshaft;

FIG. 29 (*b*) is a left side view showing the camshaft;

FIG. 29 (*c*) is a cross-sectional view taken along line XXIXc—XXIXc in FIG. 29 (*b*), showing the camshaft;

FIG. 29 (*d*) is a cross-section view taken along line XXIXd—XXIXd in FIG. 29 (*a*), showing the camshaft;

FIG. 29 (*e*) is a right side view illustrating the camshaft;

FIG. 29 (*f*) is a cross-sectional view taken along line XXIXf—XXIXf in FIG. 29 (*a*), showing the camshaft;

FIG. 29 (*g*) is a cross-sectional view taken along line XXIXg—XXIXg in FIG. 29 (*a*), showing the camshaft;

FIG. 29 (*h*) is a cross-sectional view taken along line XXIXh—XXIXh in FIG. 29 (*a*), showing the camshaft;

FIG. 29 (*i*) is a cross-sectional view taken along line XXIXi—XXIXi in FIG. 29 (*a*), showing the camshaft;

FIG. 29 (*j*) is a cross-sectional view taken along line XXIXj—XXIXj in FIG. 29 (*a*), showing the camshaft;

FIG. 29 (*k*) is a cross-sectional view taken along line XXIXk—XXIXk in FIG. 29 (*a*), showing the camshaft;

FIG. 29 (*m*) is a cross-sectional view taken along line XXIXm—XXIXm in FIG. 29 (*a*), showing the camshaft;

DETAILED DISCUSSION

Figure 1:
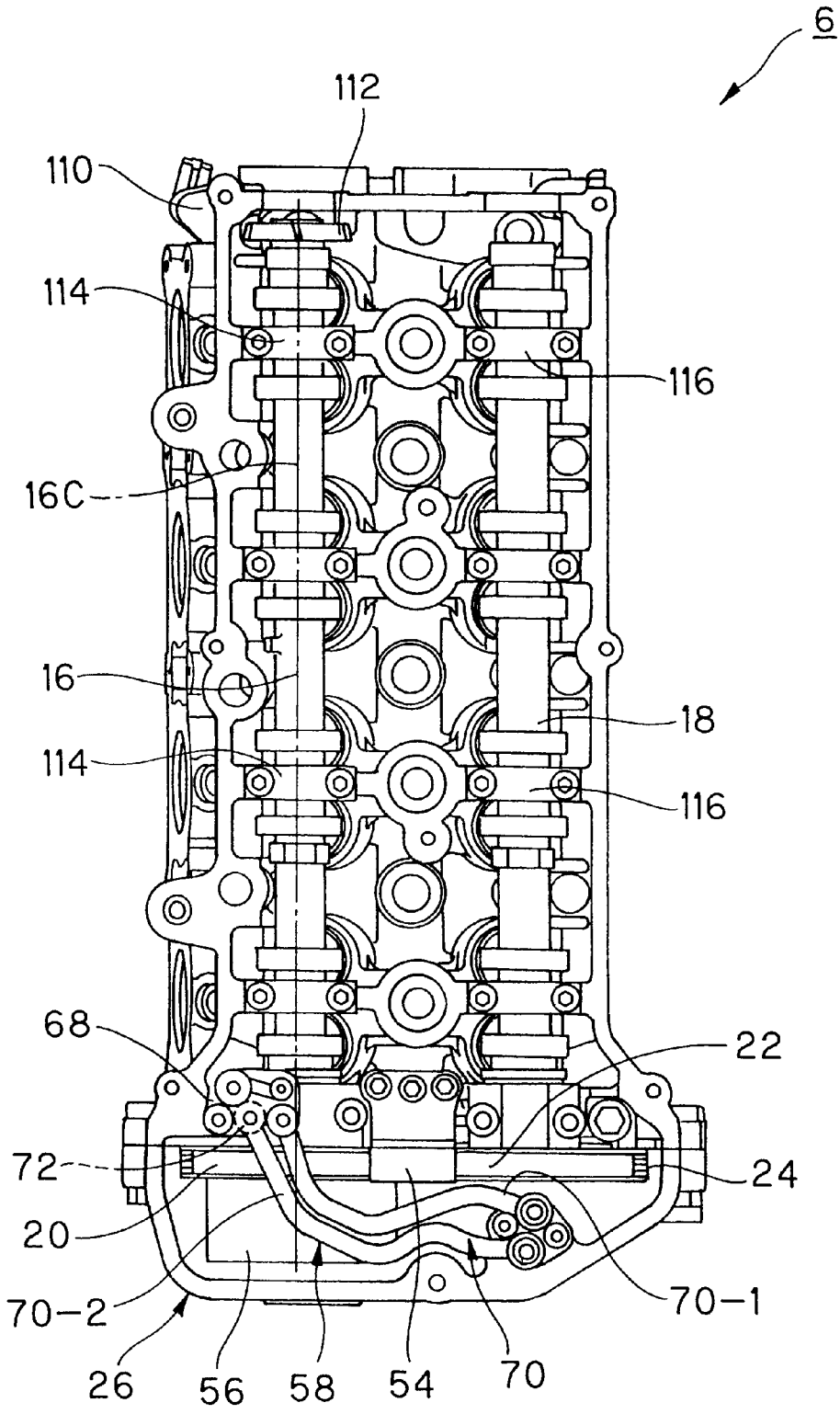
FIG. 1 is a plan view, showing a cylinder head of an engine having intake-side and exhaust-side camshafts disposed therein according to a first embodiment of the present invention.
Figure 2:
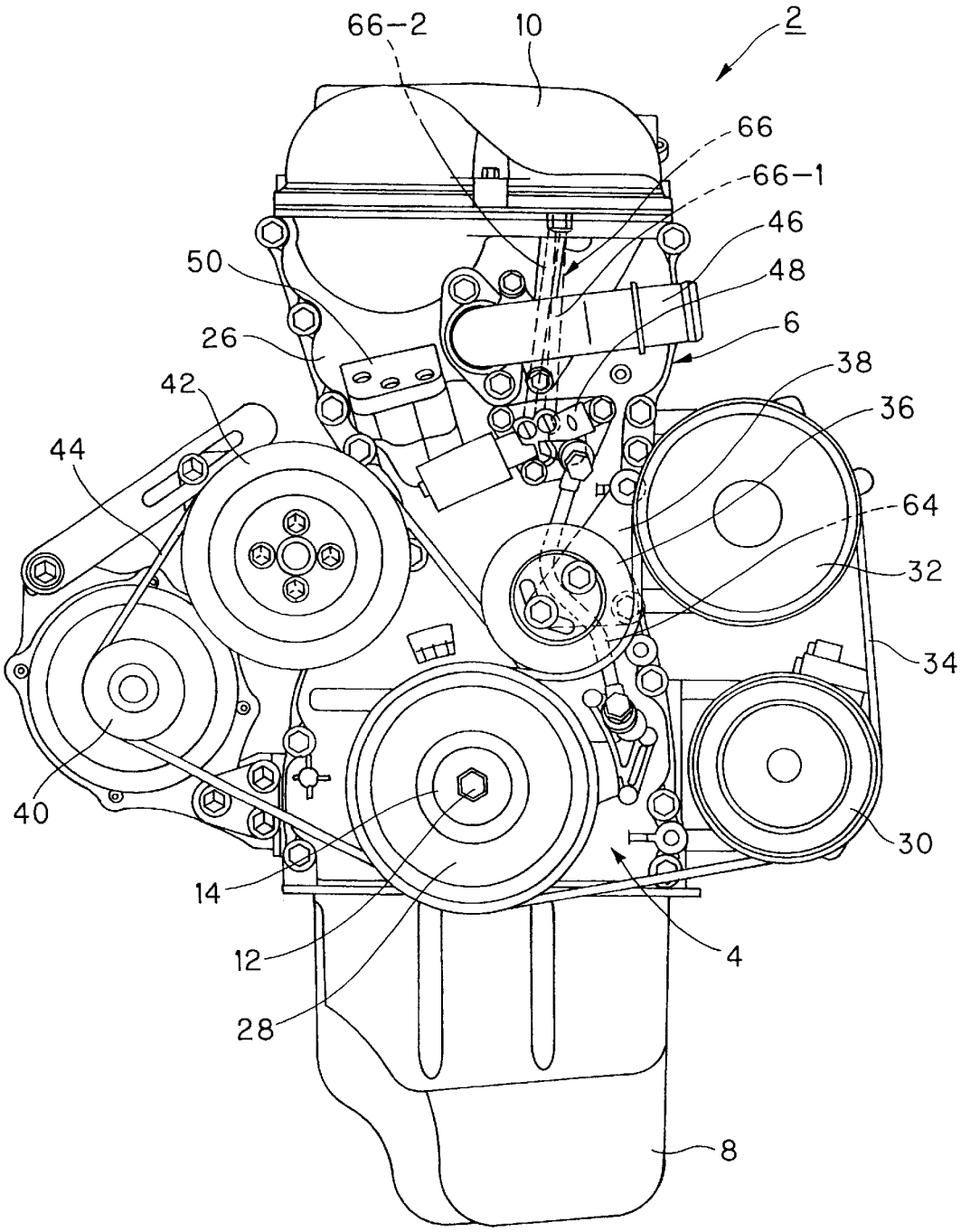
FIG. 2 is a front view showing an internal combustion engine.

FIGS. 1–29 illustrate a first embodiment. In FIGS. 1 and 2, reference numerals 2 and 4 denote an internal combustion engine and a cylinder block, respectively.

The engine 2 has a cylinder head 6 attached to the top of the cylinder block 4, an oil pan 8 fitted to the bottom of the cylinder block 6, and a cylinder head cover 10 mounted on the top of the cylinder head 6.

Figure 3:
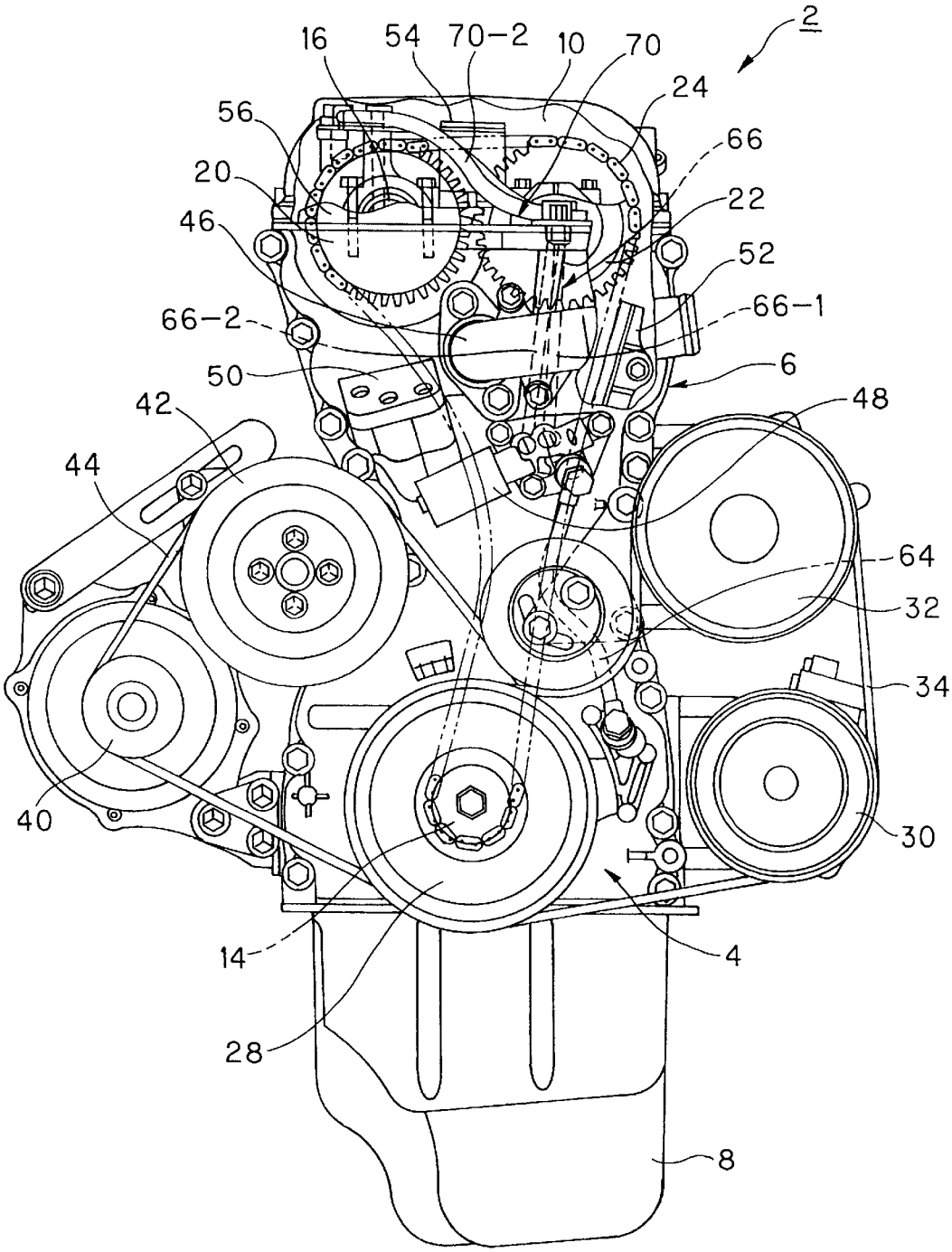
FIG. 3 is a front view illustrating the engine with part of a timing case broken away.

As shown in FIG. 3, the engine 2 is provided with a crankshaft 12 extending between one end of the engine 2 and the other end thereof. A crank sprocket 14 is mounted on the crankshaft 12. An intake-side camshaft 16 and a exhaust-side camshaft 18 are disposed parallel to the crankshaft 12.

There is provided a timing chain 24 entrained around the crank sprocket 14, an intake-side cam sprocket 20, and an exhaust-side cam sprocket 22. The cam sprockets 20, 22 are fitted to the camshafts 16, 18, respectively. A timing case 26 is disposed on one side of the engine 2. The timing case 26 is a chain cover that encloses the timing chain 24.

Various pulleys are provided outside the timing case 26. More specifically, as illustrated in FIG. 2, a crank pulley 28 is disposed on the crankshaft 12 at one end thereof. In addition, an air-conditioning compressor pulley 30 and a power steering pump pulley 32 are disposed adjacent the crank pulley 28. An air-conditioning power steering belt 34 is wrapped around the above three pulleys 28, 30, and 32. A belt tensioner pulley 36 is provided on the engine 2 in communication therewith by means of a belt tensioner bracket 38. The belt tensioner 36 contacts the air-conditioning power steering belt 34 at a location substantially midway therealong.

An alternator pulley 40 and a water pump pulley 42 are positioned outside the timing case 26. An alternator water pump belt 44 is reeved between the pulleys 40, 42.

A water outlet pipe 46, an oil control valve (also called "OCV") 48, and an engine mount-mounting portion 50 are provided outside the timing case 26.

As shown in FIG. 3, first and second timing chain guides 52, 54 are provided against the timing chain 24 for adjusting the tension of the timing chain 24. The first timing chain guide 52 is positioned against the timing chain 24 toward the power steering pump pulley 32. The second timing chain guide 54 is disposed on the top of the timing chain 24.

Figure 5:
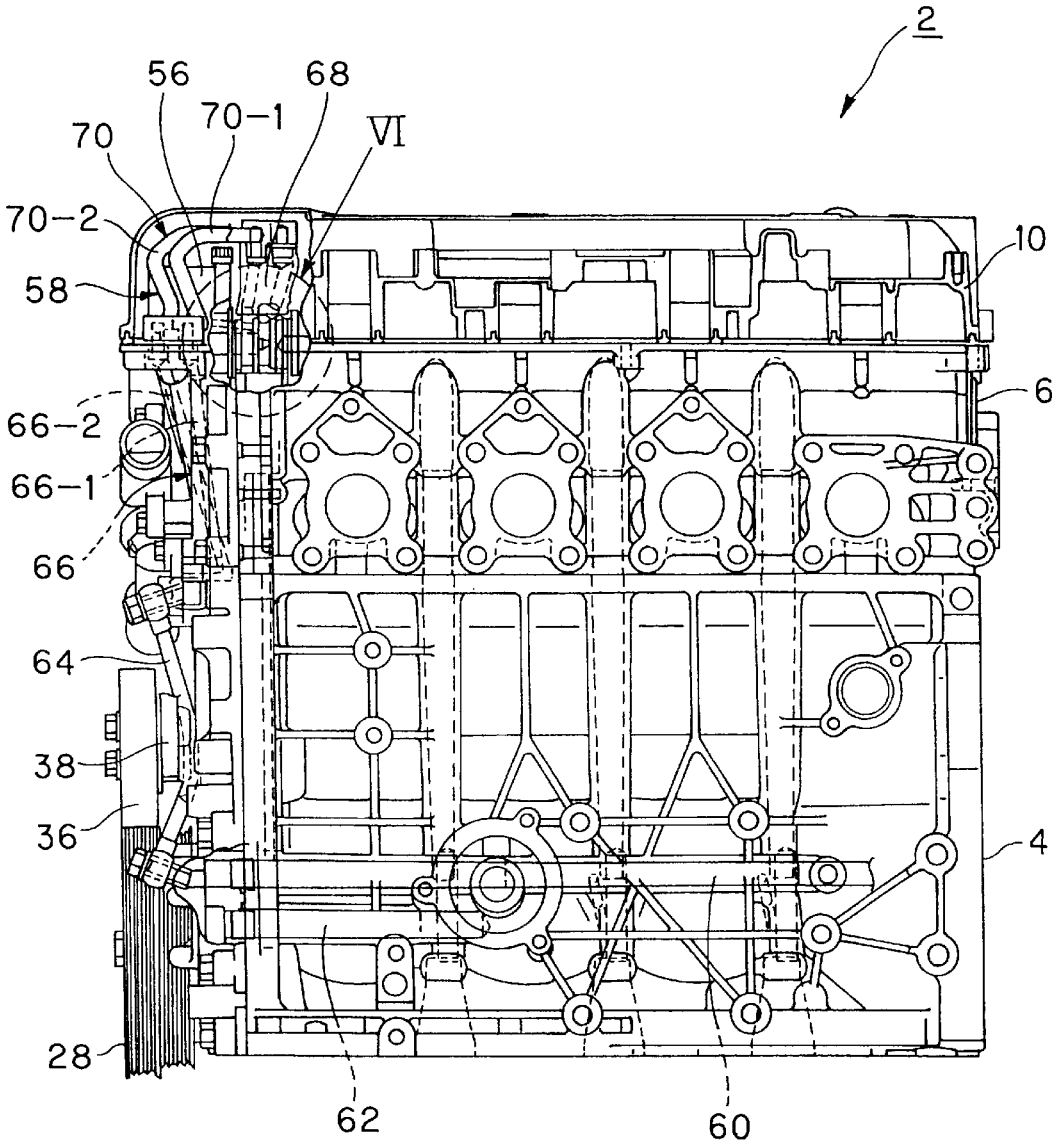
FIG. 5 is a cross-sectional view, illustrating the engine at respective portions of the cylinder block and cylinder head.

As seen from FIGS. 1, 3, and 5, a variable valve timing (also referred to as "VVT") actuator 56 is positioned on a camshaft, e.g., an intake-side camshaft 16 on one side thereof. In addition, there is provided an oil passage 58 designed for drive. The oil passage 58 uses engine oil as drive pressure on the actuator 56.

Aside from the oil passage 58, the engine 2 includes an oil passage suited for lubrication and cooling (not shown). This oil passage (not shown) supplies the engine oil to lubricated sections. The engine oil is drawn upward from the oil pan 8 by means of an oil pump (not shown). The oil pump (not shown) is integrally formed in the timing case 26.

Referring to FIG. 5, the oil passage 58 is shown communicated to a main gallery 60 of the engine 2, and the engine oil in the main gallery 60 is thereby guided into the actuator 56 in order to regulate valve timing toward spark advance or delay. The main gallery 60 receives the engine oil from a sub-gallery 62 through an oil filter (not shown).

The oil passage 58 for supplying the engine oil to the actuator 56 is connected at an upstream side thereof to a downstream side of the oil pump (not shown). The downstream side of the oil passage 58 is positioned inside the timing case 26 and around the cam sprocket 20.

More specifically, as shown in FIG. 5, the oil passage 58 includes a first oil pipe 64, an internal passage 66, and a second oil pipe 70. The first oil pipe 64 communicates the main gallery 60 with the oil control valve 48 that is attached to one side of the engine 2. The internal passage 66 is communicated to the oil control valve 48. The internal passage 66 is formed inside the timing case 26. The second oil pipe 70 communicates the internal passage 66 with the cam housing 68. The second oil pipe 70 is mounted on the cam housing 68 at a position offset outward from the engine 2 in a transverse direction of the engine 2 with respect to the intake-side camshaft 16.

In other words, as illustrated in FIGS. 2, 3, and 5, the first oil pipe 64 is made of a single pipe. The internal passage 66 consists of two passages, i.e., an advance-side internal passage 66-1 and a delay-side internal passage 66-2. The second oil pipe 70 includes two pipes, i.e., an advance-side second oil pipe 70-1 and a delay-side second oil pipe 70-2.

Thus, the oil passage 58 is not provided in components produced by large-scaled facilities such as the cylinder block 4 or the cylinder head 6, but is provided using components fabricated by small-scaled facilities or small-sized components such as the timing case 26, the cam housing 68, the pipes, and the like.

As seen from FIG. 1, the advance-side second oil pipe 70-1 positioned in an inward direction of the second oil pipe 70 is mounted on the cam housing 68 at a location offset outward from the engine 2 in the transverse direction of the engine 2 with respect to centerline 16C of the intake-side camshaft 16.

When the advance-side second oil pipe 70-1 is mounted on the cam housing 68 offset outward from the engine 2 in the transverse direction thereof with respect to centerline 16C, then the advance-side second oil pipe 70-1 is mounted on the cam housing at a position above a cam housing bolt 72 (see FIG. 1) of the cam housing 68, i.e., above a counterbore hole portion 74 of the cam housing bolt 72, as shown in FIGS. 28 (*a*) and 28 (*b*).

Figure 4:
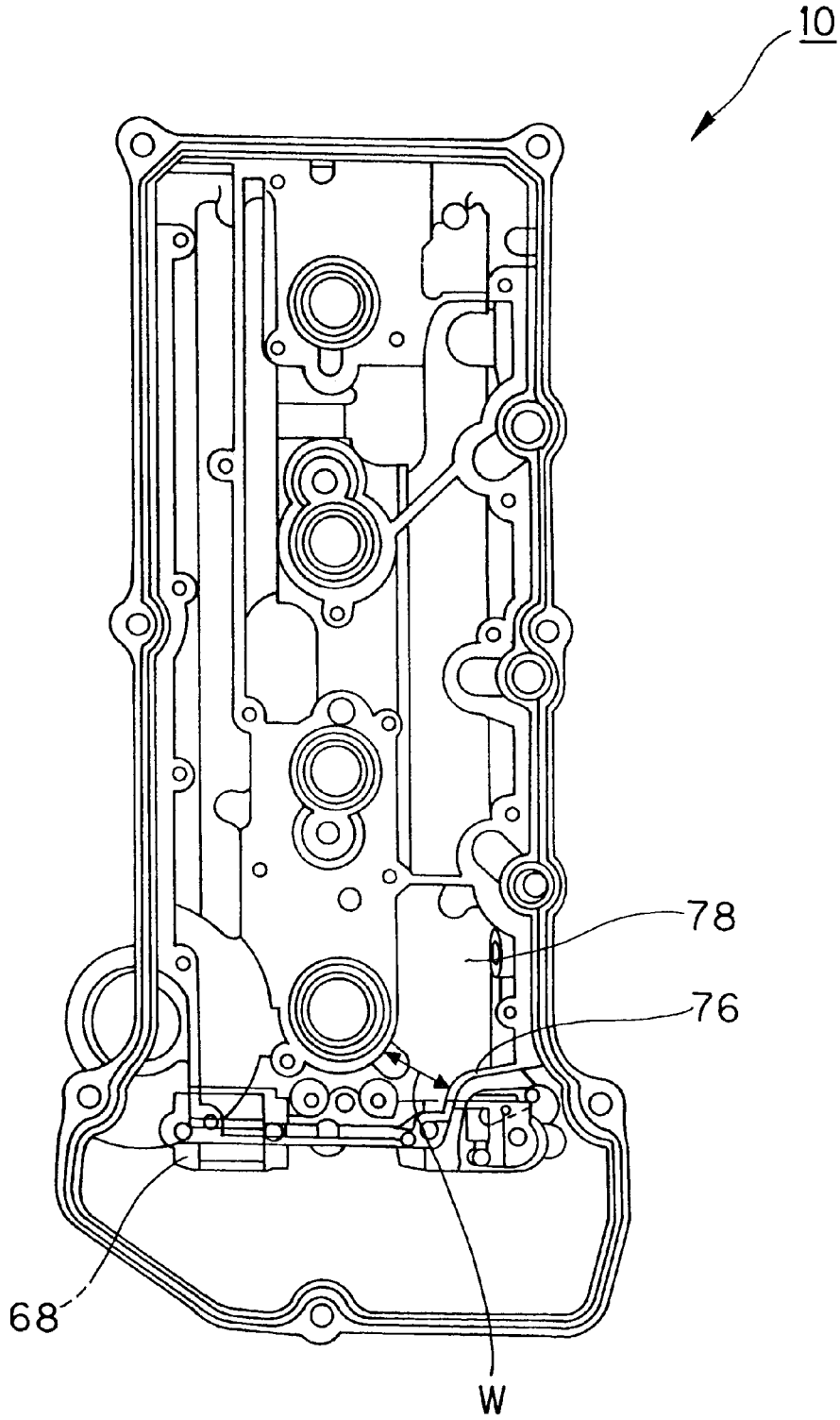
FIG. 4 is a bottom view illustrating a cylinder head cover.

In addition, since the advance-side second oil pipe 70-1 is positioned offset on the cam housing 68, a relief portion 76 formed on the reverse side of the cylinder head cover 10 protrudes toward a breather chamber 78 by a small amount, as shown in FIG. 4. As a result, passage width "W", is sufficiently ensured.

The second oil pipe 70 is positioned over the timing chain 24 at a central portion or on centerline 16C of the camshaft 16 or at a position outwardly shifted from centerline 16C. The timing chain 24 is trained around the intake-side cam sprocket 20.

More specifically, as illustrated in FIG. 1, the advance-side second oil pipe 70-1 is positioned so as to span over the timing chain 24 on centerline 16C. Meanwhile, the delay-side second oil pipe 70-2 extends over the timing chain 24 at a position outward from the advance-side second oil pipe 70-1, i.e., at a location outwardly moved from centerline 16C.

In addition, the second oil pipe 70 includes two pipes different in length, i.e., the advance-side second oil pipe 70-1 and the delay-side second oil pipe 70-2. As illustrated in FIG. 1, the shorter pipe or the advance-side second oil pipe 70-1 functions as an advance-side oil passage 82 that leads to the actuator 56. Further, a plurality of oil grooves 80 (FIG. 6) are provided between the intake-side camshaft 16 and the cam housing 68. Some of the oil groove 80 located toward the intake-side cam sprocket 20 serve as the advance-side oil passages 82 that lead to the actuator 56.

Figure 6:
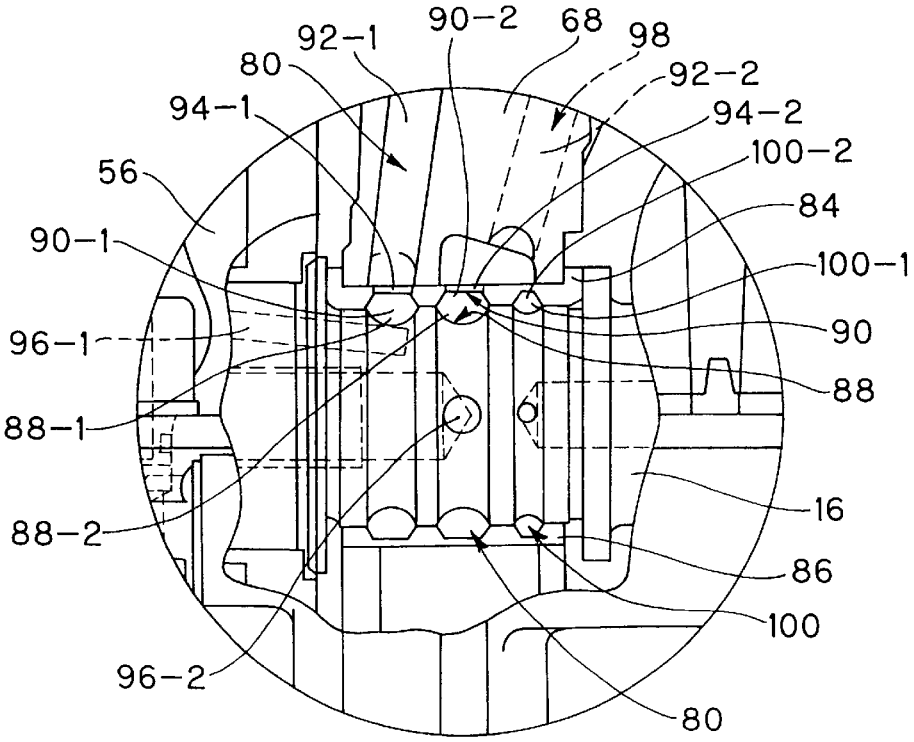
FIG. 6 is an enlarged view, showing a portion designated by arrow VI in FIG. 5.
Figure 7:
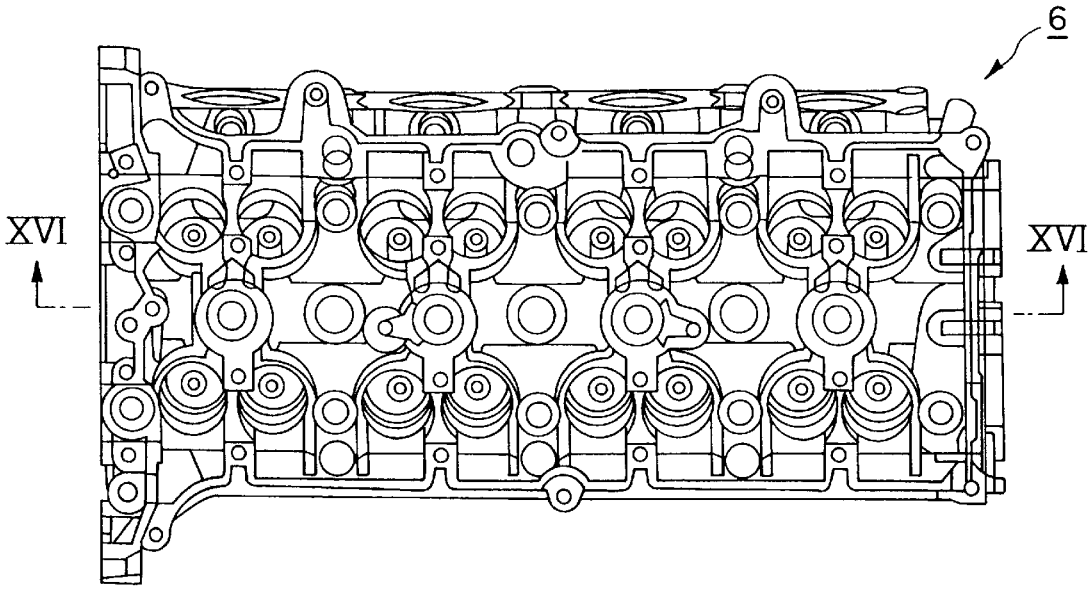
FIG. 7 is a plan view showing the cylinder head.
Figure 8:
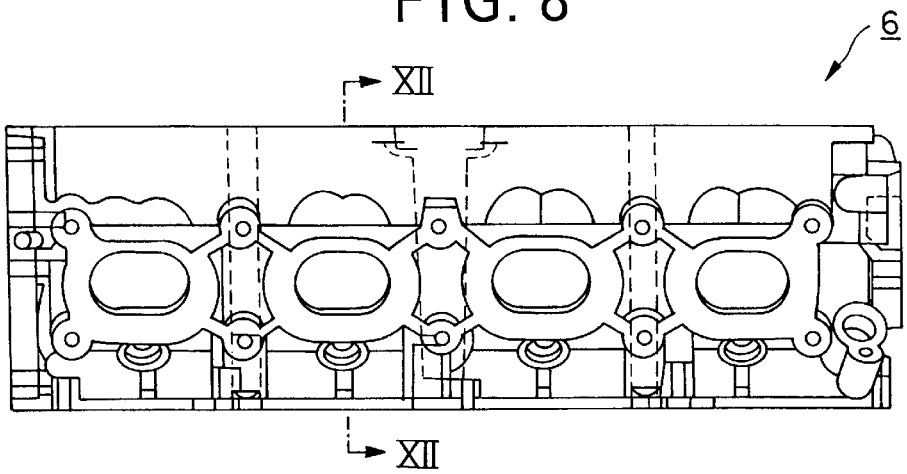
FIG. 8 is a rear view illustrating the cylinder head.
Figure 9:
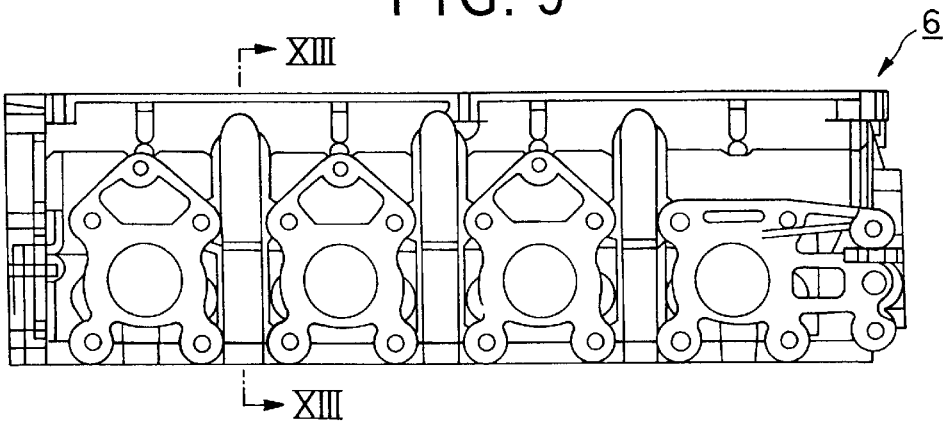
FIG. 9 is a front view showing the cylinder head.
Figure 10:
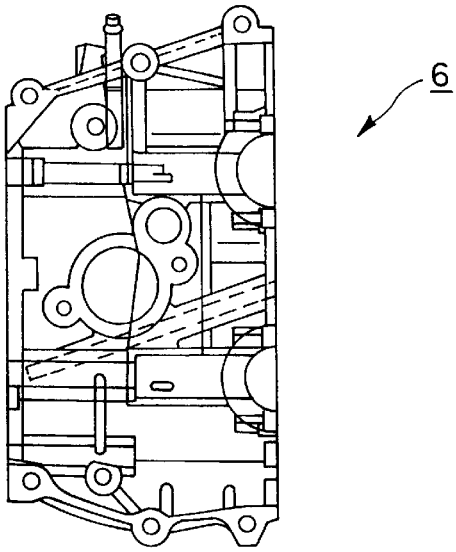
FIG. 10 is a left side view showing the cylinder head.
Figure 11:
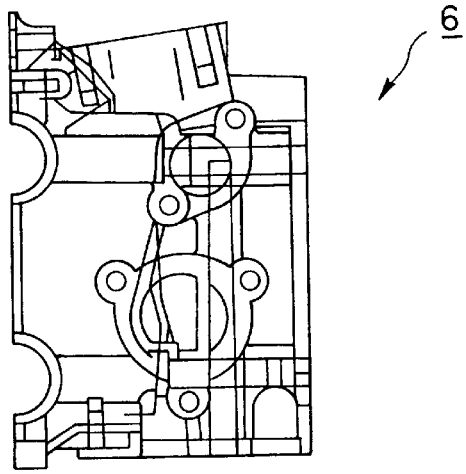
FIG. 11 is a right side view illustrating the cylinder head.
Figure 12:
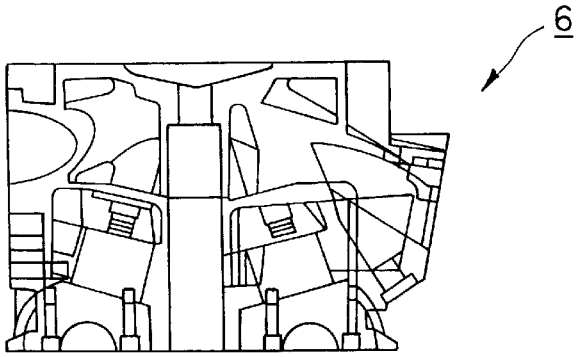
FIG. 12 is a cross-sectional view taken along line XII—XII of FIG. 8.
Figure 13:
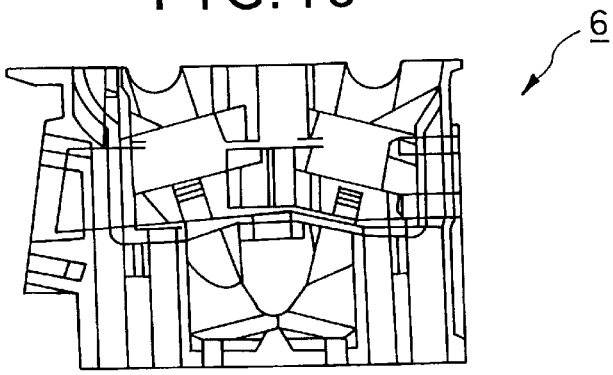
FIG. 13 is a cross-sectional view taken along line XIII—XIII of FIG. 9.
Figure 14:
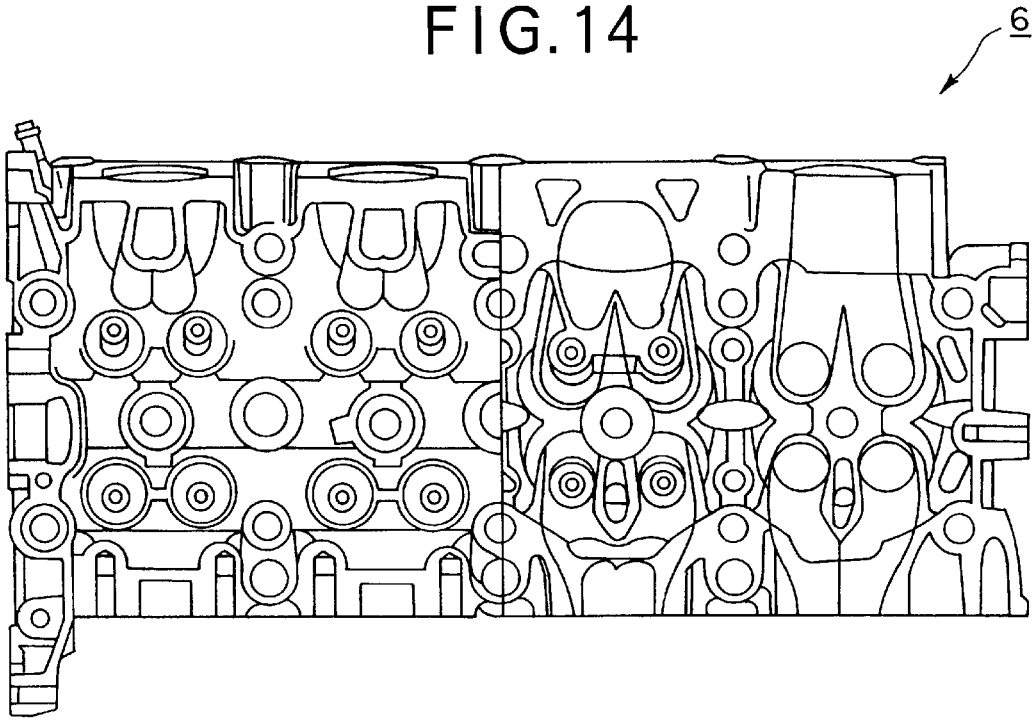
FIG. 14 is a plan view, illustrating the cylinder head, with various cross-sectional portions thereof being shown together.
Figure 15:
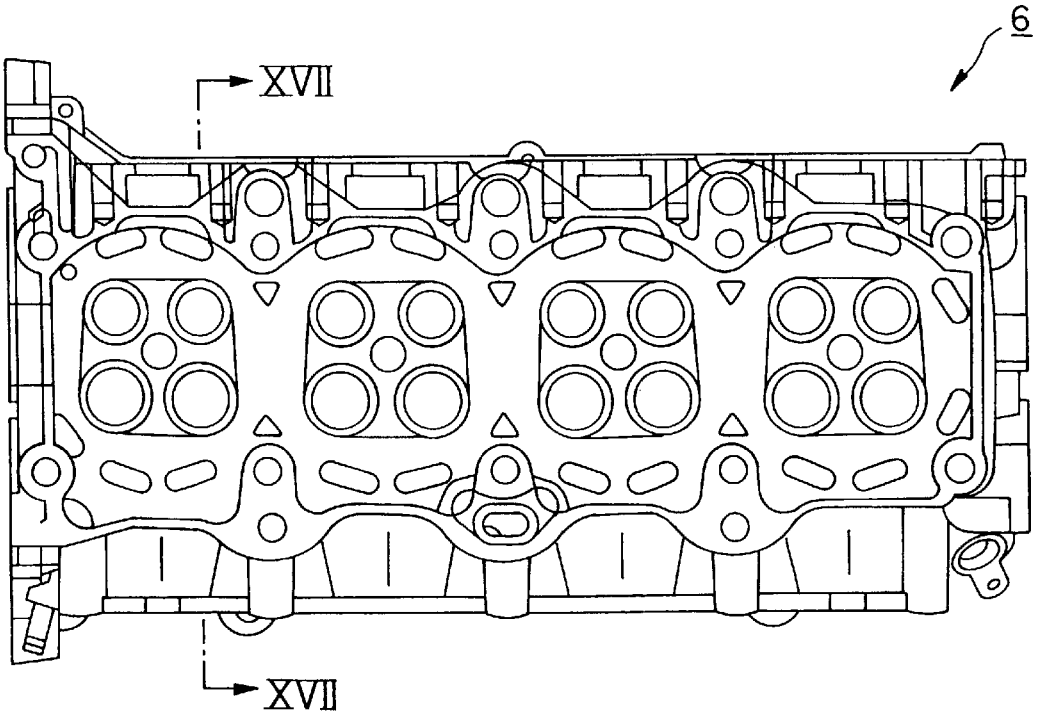
FIG. 15 is a bottom view showing the cylinder head.
Figure 16:
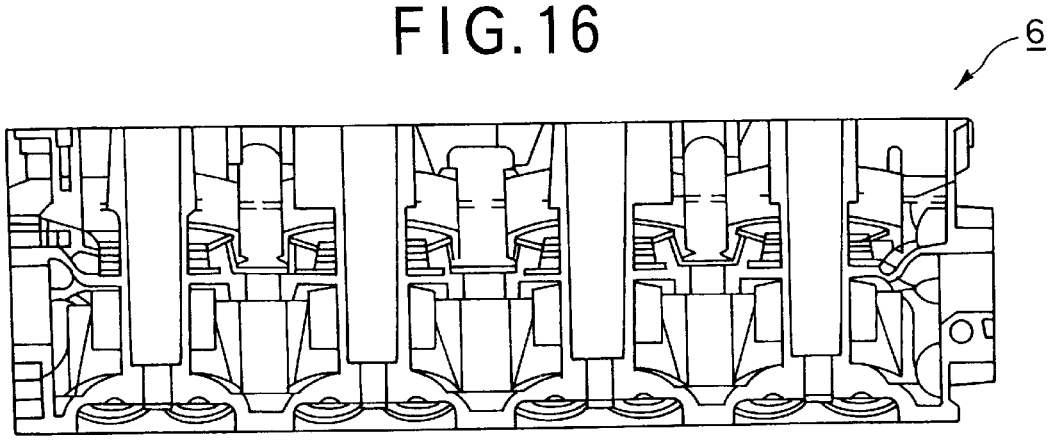
FIG. 16 is a longitudinal cross-sectional view showing the center of the cylinder head.
Figure 17:
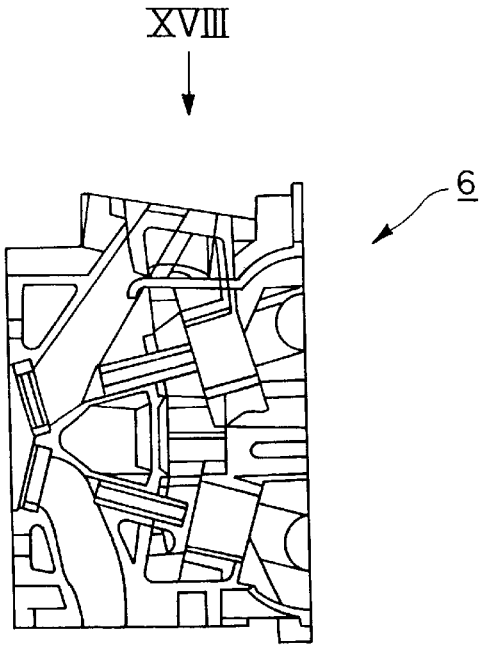
FIG. 17 is a cross-sectional view taken along line XVII—XVII of FIG. 15.
Figure 18:
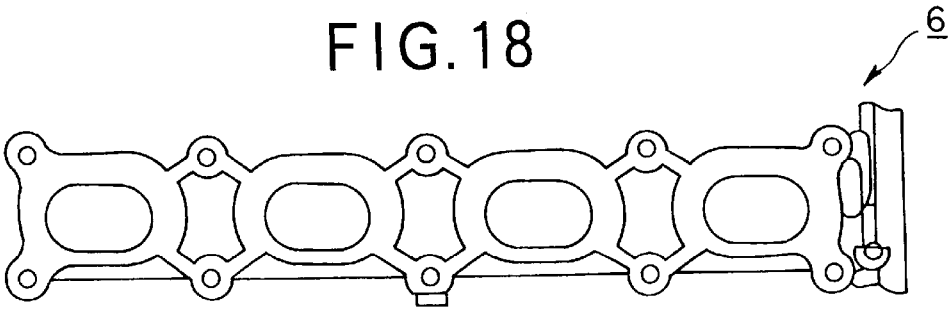
FIG. 18 is a schematic view illustrating the cylinder head when viewed from arrow XVIII in FIG. 17.

More specifically, as illustrated in FIG. 6, the oil groove 80 includes a camshaft-side oil groove 88 and a camshaft bearing-side oil groove 90. The oil grooves 88, 90 are formed between the intake-side camshaft 16 and a camshaft bearing upper 84 and between the camshaft 16 and a camshaft bearing lower 86.

The advance-side oil passage 82 leading to the actuator 56 includes a cam housing-side advance internal passage 92-1, an advance-side communication hole portion 94-1, and a camshaft-side advance internal passage 96-1. The passage 92-1 is formed in the cam housing 68. The hole portion 94-1 communicates the above passage 92-1 with a camshaft bearing-side advance oil groove portion 90-1 of the oil groove 80. The passage 96-1 communicates a camshaft-side advance oil groove 88-1 of the oil groove 80 with the actuator 56.

A delay-side oil passage 98 leading to the actuator 56 includes a cam housing-side delay internal passage 92-2, a delay-side communication hole portion 94-2, and a camshaft-side delay internal passage 96-2. The passage 92-2 is formed in the cam housing 68. The hole portion 94-2 communicates the above passage 92-2 with a camshaft bearing-side delay oil groove portion 90-2 of the oil groove 80. The passage 96-2 communicates a camshaft-side delay oil groove 88-2 of the oil groove 80 with the actuator 56.

A lubrication oil groove 100 is formed between the camshaft 16 and the camshaft bearing upper 84 and between the camshaft 16 and the camshaft bearing lower 86. The oil groove 100 includes a camshaft-side lubrication oil groove 100-1 and a camshaft bearing-side lubrication oil groove 100-2.

FIG. 29 discloses details of the camshaft 16 just for reference. As illustrated in FIG. 29 (*a*), a shaft portion 16*a* is formed with a plurality of cam portions 16*b*. The shaft portion 16*a* has the following three annular oil groove portions defined at one side thereof: a camshaft-side advance oil groove portion 88-1; a camshaft-side delay oil groove portion 88-2; and, a camshaft-side lubrication oil groove 100-1.

Figure 19:
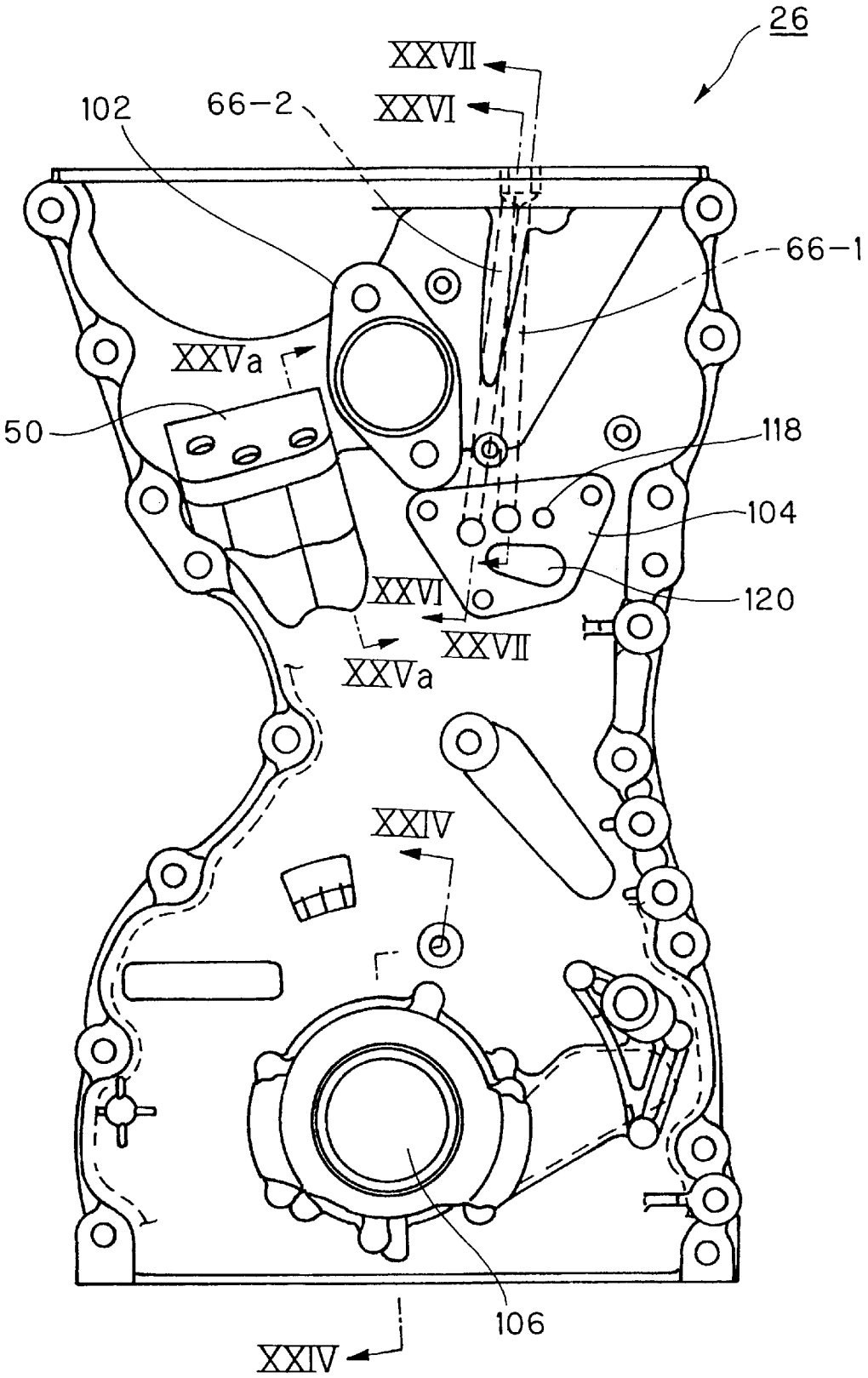
FIG. 19 is a front view showing a timing case.
Figure 21:
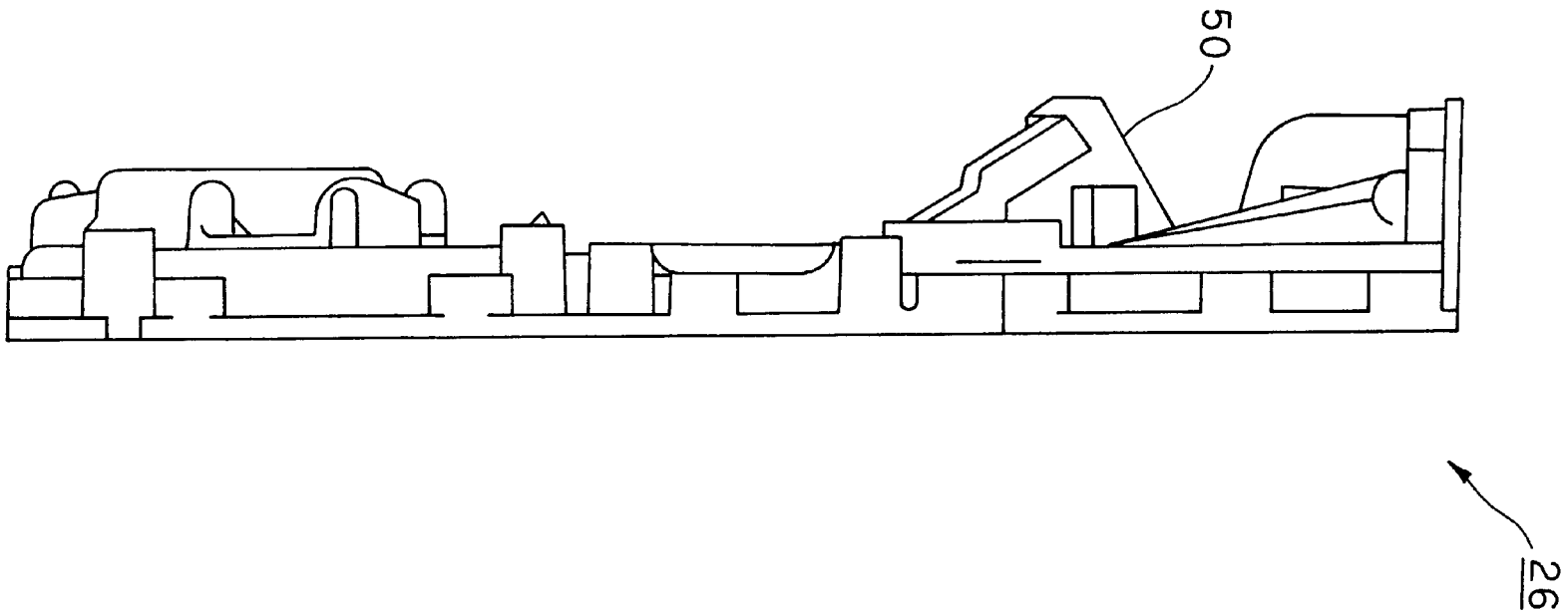
FIG. 21 is a right side view showing the timing case.
Figure 22:
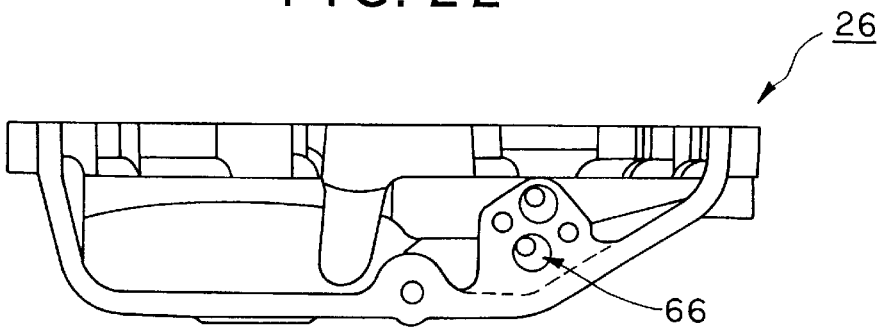
FIG. 22 is a plan view illustrating the timing case.
Figure 23:
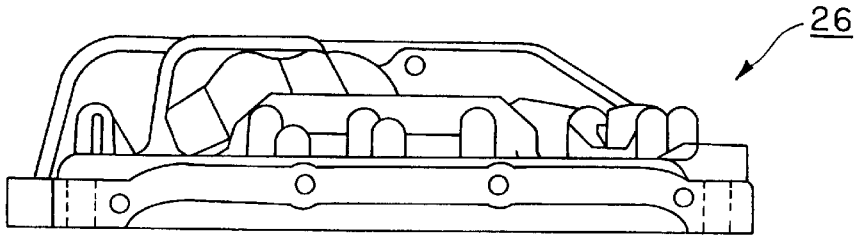
FIG. 23 is a bottom view illustrating the timing case.
Figure 25A:
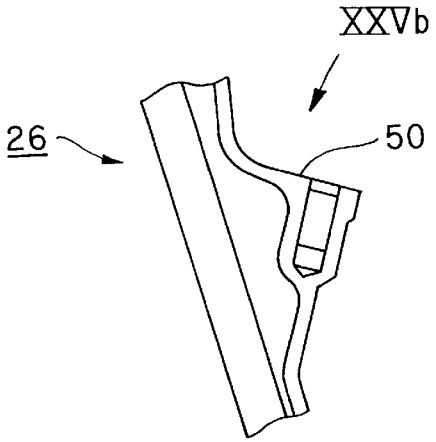
FIG. 25 (*a*) is a cross-sectional view taken along line XXVa—XXVa in FIG. 19.
Figure 25B:
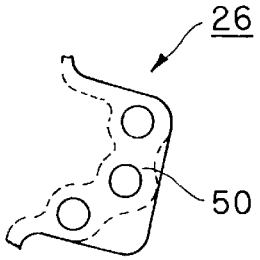
Figure 26:
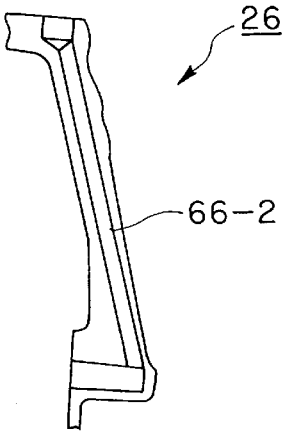
FIG. 26 is a cross-sectional view taken along line XXVI—XXVI in FIG. 19.
Figure 27:
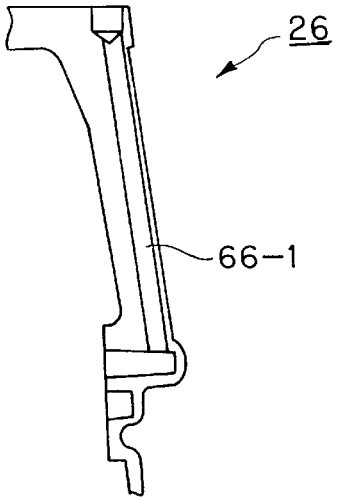
FIG. 27 is a cross-sectional view taken along line XXVII—XXVII in FIG. 19.
Figure 28A:
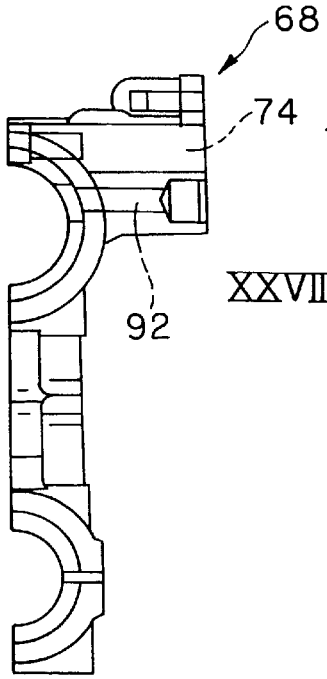
FIG. 28 (*a*) is a left side view showing a cam housing.
Figure 28B:
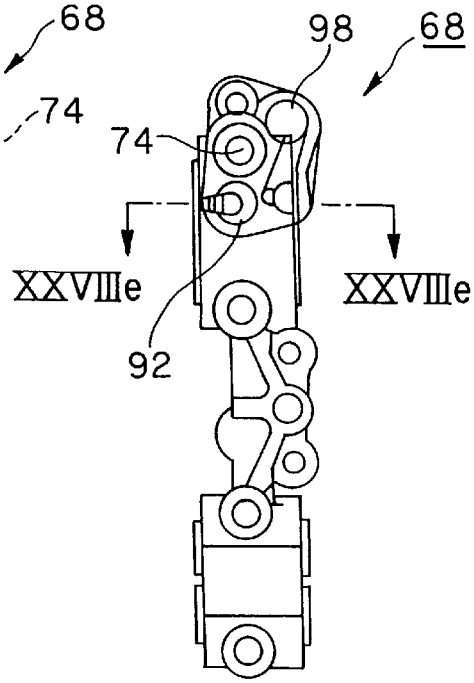
Figure 28C:
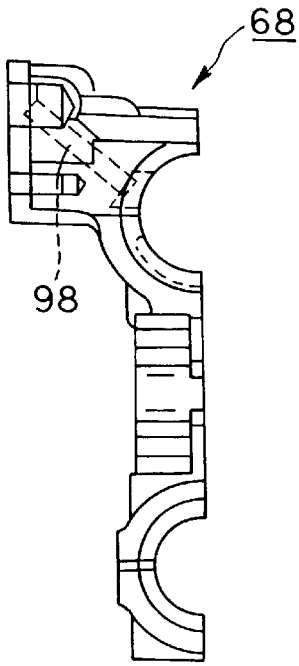
Figure 28D:
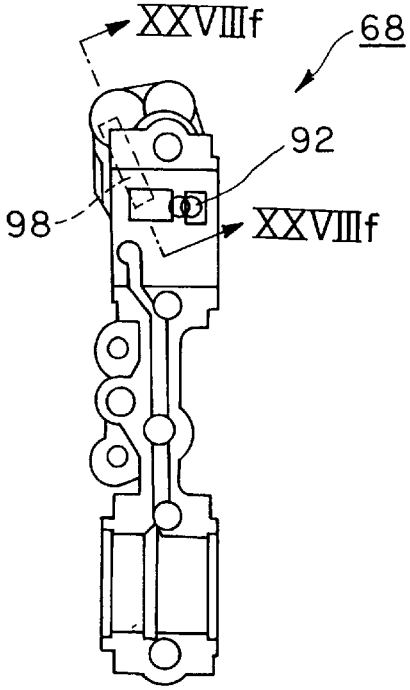
Figure 28E:
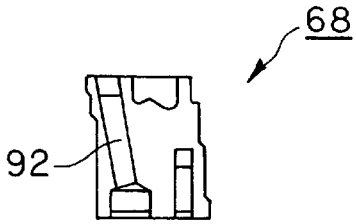
Figure 28F:
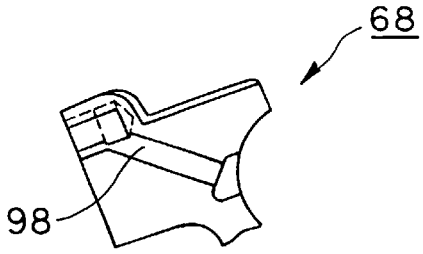

Attention is now directed to details of the timing case 26. As illustrated in FIGS. 19, 21, and 25, one bearing surface 102 and another bearing surface 104 are formed at a surface of the timing case 26. The water outlet pipe 46 is mounted on the former bearing surface 102, while the oil control valve (also called "OCV") 48 is mounted on the latter bearing surface 104. In addition, the engine mount-mounting portion 50 is integrally formed at the surface of the timing case 26.

Referring to FIGS. 19, 20, 22, 26, and 27, a projecting internal passage 66 is formed on the reverse side of the timing case 26. The internal passage 66 includes an advance-side internal passage 66-1 and a delay-side internal passage 66-2.

Figure 20:
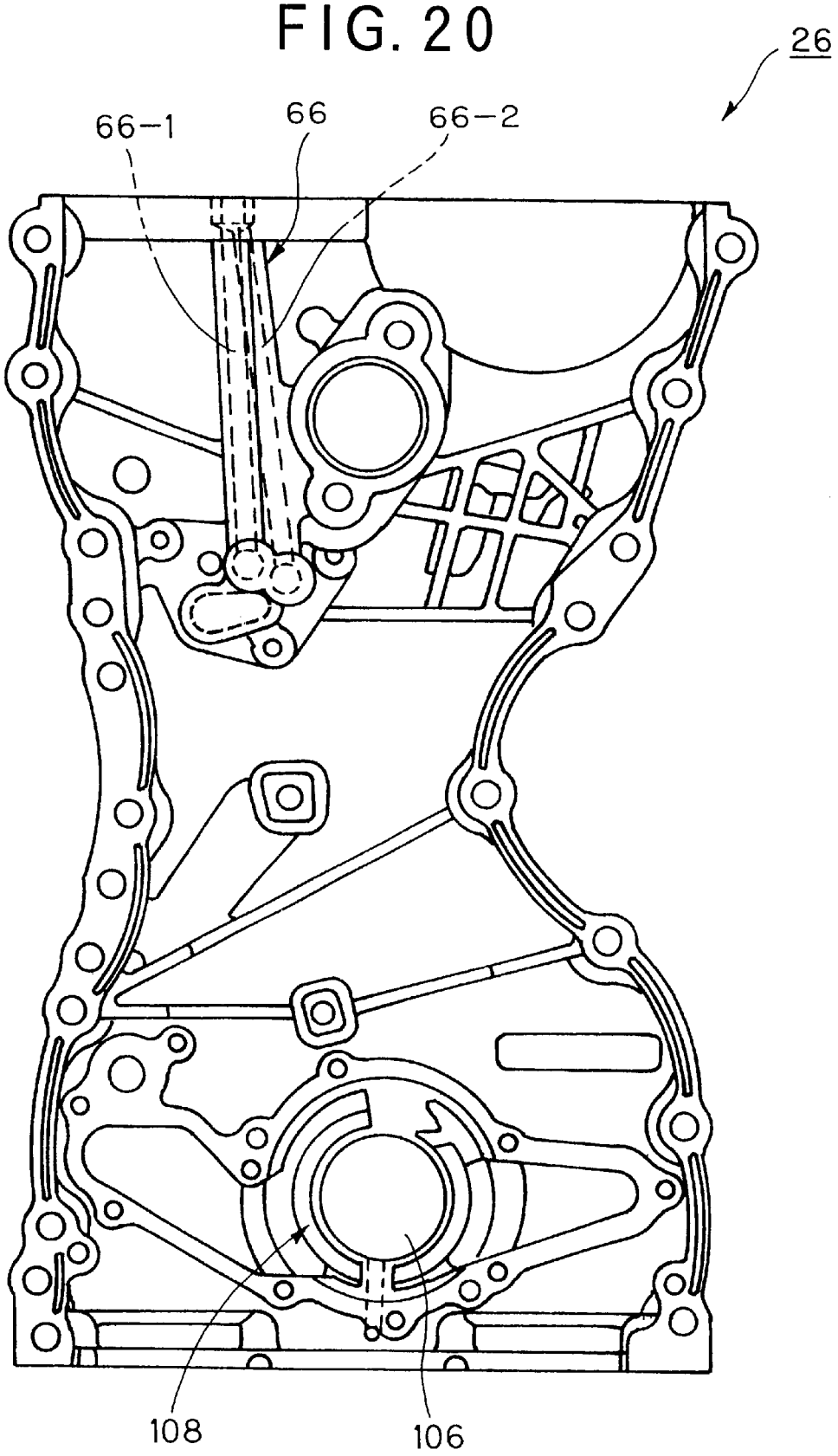
FIG. 20 is a rear view showing the timing case.
Figure 24:
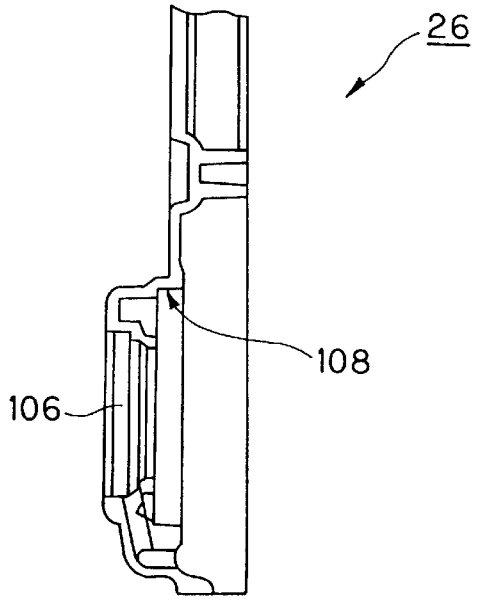
FIG. 24 is a cross-sectional view taken along line XXIV—XXIV in FIG. 19.

As illustrated in FIGS. 19, 20, and 24, a crankshaft-mounting hole portion 106 is formed on the surface of the timing case 26 at a lower section thereof. The crankshaft-mounting hole portion 106 protrudes outward around the periphery thereof. The oil pump is disposed at a position rearward from the crankshaft-mounting mounting hole portion 106 and inward from a concave portion 108.

Reference numeral 110 (FIG. 1) denotes a cam angle sensor disposed adjacent to the other side of the intake-side camshaft 16; 112 a rotor designed for the cam angle sensor, the rotor being attached to the other side of the camshaft 16; 114 a plurality of intake cam housings for fixing the camshaft 16 to the cylinder head 6; 116 a plurality of exhaust cam housings for fixing the exhaust-side camshaft 18 to the cylinder head 6; 118 (FIG. 19) drain hole portions formed at the bearing surface 104, on which the oil control valve (also called "OCV" 48) is mounted; and, 120 an oil passage groove communicated to the first oil pipe 64.

Next, the operation of the first embodiment will be described.

The engine oil flowing in the engine 2 is pumped up from the oil pan 8 by means of an oil pump (not shown), and is then delivered to the main gallery 60 through the sub-gallery.

The engine oil is supplied to lubricated sections from the main gallery 60 through an oil passage designed for lubrication and cooling (not shown). Meanwhile, the engine oil is fed to the drive-adapted oil passage 58 as well, and is then introduced into the variable valve timing actuator 56 in order to adjust valve timing toward spark advance or delay.

The oil, which has reached the oil passage 58, is delivered to the oil control valve 48 through the first oil pipe 64. The oil control valve 48 executes a supply of oil toward spark advance or delay.

As illustrated in FIGS. 2, 3, and 5, for the spark advance, the oil is fed to the advance-side second oil pipe 70-1 of the second oil pipe 70 from the oil control valve 48 through the advance-side internal passage 66-1 of the internal passage 66. The oil is then caused to flow through the cam housing-side advance internal passage 92-1, the advance-side communication hole portion 94-1, and the camshaft-side advance oil groove portion 88-1 of the oil groove 80 from the advance-side second oil pipe 70-1. The passage 92-1 is formed in the cam housing 68. The oil is eventually supplied to the actuator 56 through the camshaft-side advance internal passage 96-1.

As shown in FIGS. 2, 3, and 5, for the spark delay, the oil is conveyed to the delay-side second oil pipe 70-2 of the second oil pipe 70 from the oil control valve 48 through the delay-side internal passage 66-2 of the internal passage 66. The oil is then caused to flow through the cam housing-side delay internal passage 92-2, the delay-side communication hole portion 94-2, and the camshaft-side delay oil groove portion 88-2 of the oil groove 80 from the delay-side second oil pipe 70-2. The passage 92-2 is formed in the cam housing 68. The oil is eventually supplied to the actuator 56 through the camshaft-side delay internal passage 96-2.

Referring to FIGS. 1 and 3, part of the oil passage 58, i.e., the second oil pipe 70, is shown disposed inside the timing case 26 and around the intake-side cam sprocket 20.

As shown in FIG. 1, the second oil pipe 70 is mounted on the cam housing 68 at a position offset outward with respect to centerline 16C of the intake-side camshaft 16.

Figure 32:
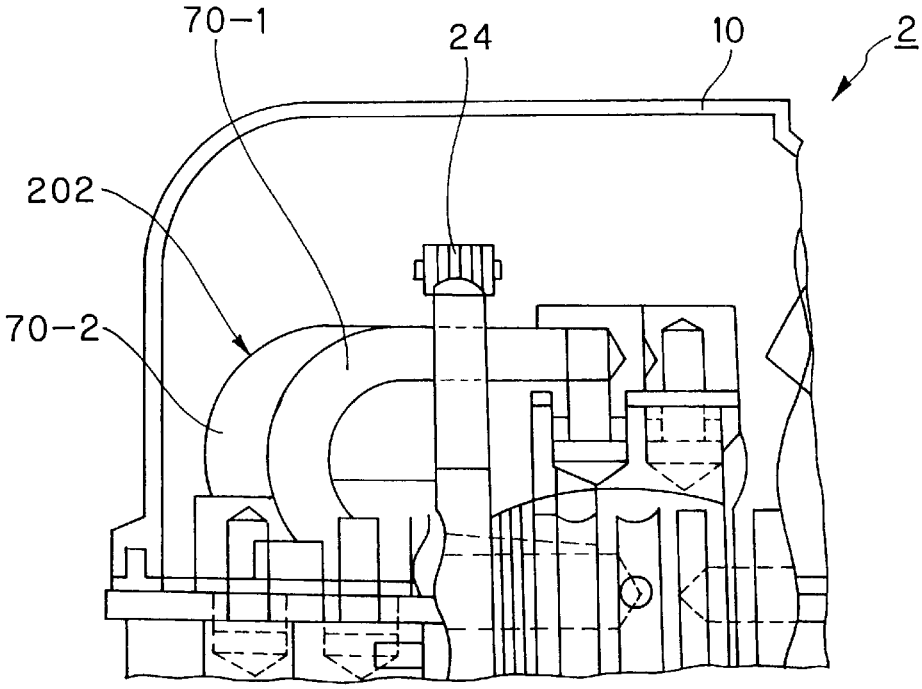
FIG. 32 is an enlarged right side view illustrating an essential portion of the camshaft on one side thereof.

As shown in FIG. 32, the advance-side second oil pipe 70-1 is mounted on the cam housing 68 at a position above a cam housing bolt 72 (see FIG. 1) of the cam housing 68, i.e., above the counterbore hole portion 74 of the cam housing bolt 72. As illustrated in FIG. 4, the relief portion 76 formed on the reverse side of the cylinder head cover 10 protrudes toward the breather chamber 78 by a small amount, thereby ensuring sufficient passage width "W."

Further, the second oil pipe 70 is positioned over the timing chain 24 on centerline 16C or at a position displaced outward therefrom. The timing chain 24 thereby avoids contacting the second oil pipe 70, even when the timing chain 24 is swung.

In addition, the advance-side second oil pipe 70-1 and the delay-side second oil pipe 70-2 are positioned in a manner reverse to conventional positioning. Thus, the second oil pipe 70-1 experiences a reduced loss of pressure, and the actuator 56 is operated for a reduced period of time.

The oil passage 58 for supplying the engine oil to the actuator 56 is connected at an upstream side thereof to a downstream side of the oil pump (not shown). A downstream side of the oil passage 58 is positioned inside the timing case 26 and around the cam sprocket 20. More specifically, the oil passage 58 is not provided in components produced by large-scaled facilities such as the cylinder block 4 or head 6, but is provided using those fabricated by small-scaled facilities or small-sized components such as the timing case 26, the cam housing 68, the pipes, and the like. Thus, manufacturing facilities can be changed at small costs when the existing internal combustion engine is utilized so as to meet the technical specification of the actuator 56. As a result, a low cost internal combustion engine adapted for the actuator 56 is achievable, and a reduction in cost can be realized, which is advantageous from an economical viewpoint.

Further, since the second oil pipe 70 is mounted on the cam housing 68 at a position offset outward from the engine 2 in the transverse direction thereof with reference to the camshaft 16, the relief portion 76 projects toward the breather chamber 78 by a small amount, thereby ensuring sufficient passage width "W." Such a passage width allows an oil mist to flow through the breather chamber 78 at a reduced velocity of flow. As a result, improved breather performance of the breather chamber 78 such as oil-separating performance is provided. This is advantageous in view of practical use.

Moreover, the second oil pipe 70 is positioned over the timing chain 24 on centerline 16C or at a position shifted outward therefrom. The timing chain 24 is entrained around the intake-side cam sprocket 20. As a result, even when the timing chain 24 is swung, there is no likelihood that the timing chain 24 contacts the second oil pipe 70, thereby making it possible to positively prevent damages of the second oil pipe 70.

Yet further, the second oil pipe 70 includes two pipes different in length, i.e., the advance-side second oil pipe 70-1 and the delay-side second oil pipe 70-2. The shorter pipe or the advance-side oil pipe 70-1 functions as the advance-side oil passage 82 that leads to the actuator 56. The oil grooves 80 are provided between the camshaft 16 and the cam housing 68. Some of the oil grooves 80 located toward the cam sprocket 20 serve as the advance-side oil passages 82 that lead to the actuator 56. Then, the advance-side and delay-side second oil pipes 70-1, 70-2 are positioned in a manner reverse to conventional positioning. As a result, a reduced loss of pressure in the second oil pipe 70-1 as well as reduced working time of the actuator 56 is achievable, which is advantageous in view of practical use.

Figure 30:
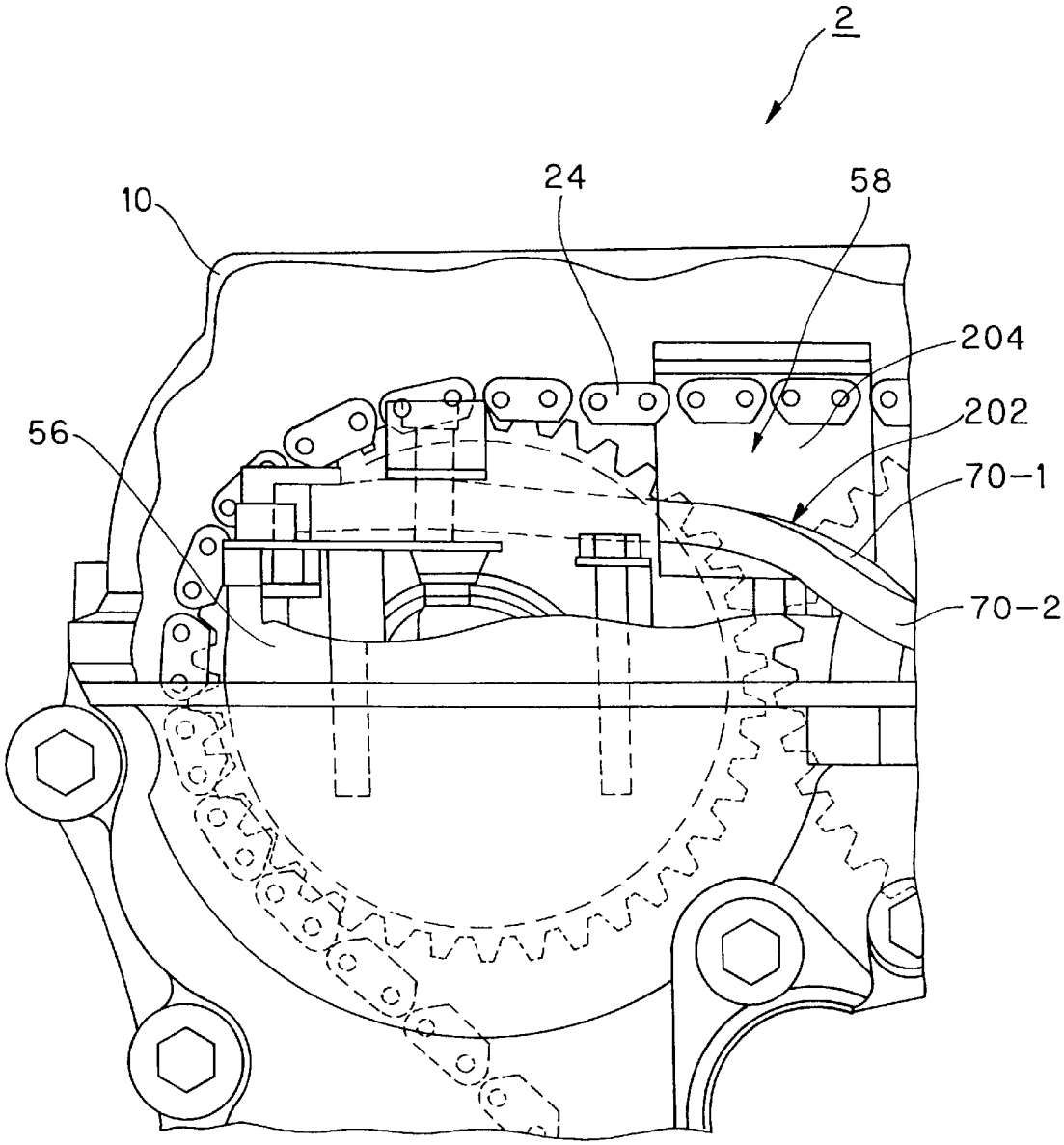
FIG. 30 is an enlarged cross-sectional view illustrating a cutaway essential portion of an intake-side camshaft on one side thereof according to a second embodiment.
Figure 31:
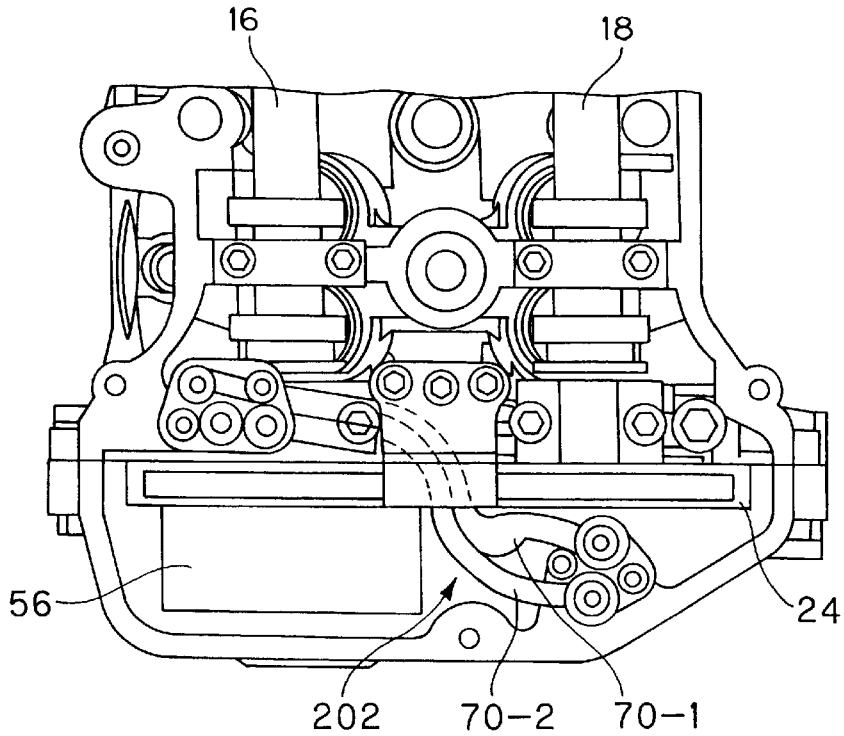
FIG. 31 is an enlarged plan view illustrating an essential portion of the camshaft on one side thereof.

FIGS. 30–32 illustrate a second embodiment of the present invention. In this embodiment, the same reference characters are hereinafter used for features identical in function to those described in the first embodiment.

The second embodiment is characterized in that a second oil pipe 202 of an oil passage 58 is laid through a void space portion 204 inside a timing chain 24.

More specifically, as shown in FIGS. 30–32, the timing chain 24, an intake-side camshaft 16, and an exhaust-side camshaft 18 form the space portion 204. The second oil pipe 202 is disposed through the space portion 204.

The second oil pipe 202 includes two pipes different in size, i.e., an advance-side second oil pipe 70-1 and a delay-side second oil pipe 70-2. Both of the pipes 70-1, 70-2 are positioned through the space 204.

Since both of the advance-side and delay-side second oil pipes 70-1, 70-2 of the second oil pipe 202 are positioned through the space 204, no piping is present above the timing chain 24. Thus, the height of the cylinder head cover 10 and thus the entire height of the engine 2 can be made smaller. As a result, there is provided a sufficient clearance between the engine 2 and an engine hood. This is advantageous in view of practical use.

The second oil pipe 202 and, in particular, the advance-side second oil pipe 70-1 can be made shorter in length. Thus, the pipe 70-1 is possible to undergo a reduced loss of pressure, and the actuator 56 is operable for a reduced period of time.

This invention is not limited to the above-described first and second embodiments, but may be susceptible to various applications, modifications, and variations.

For example, although a second timing chain guide 54 of the timing chain 24 and the second oil pipe 70 are separately formed according to the first embodiment, the timing chain guide 54 and the second oil pipe 70 may be integrally formed together.

Figure 33:
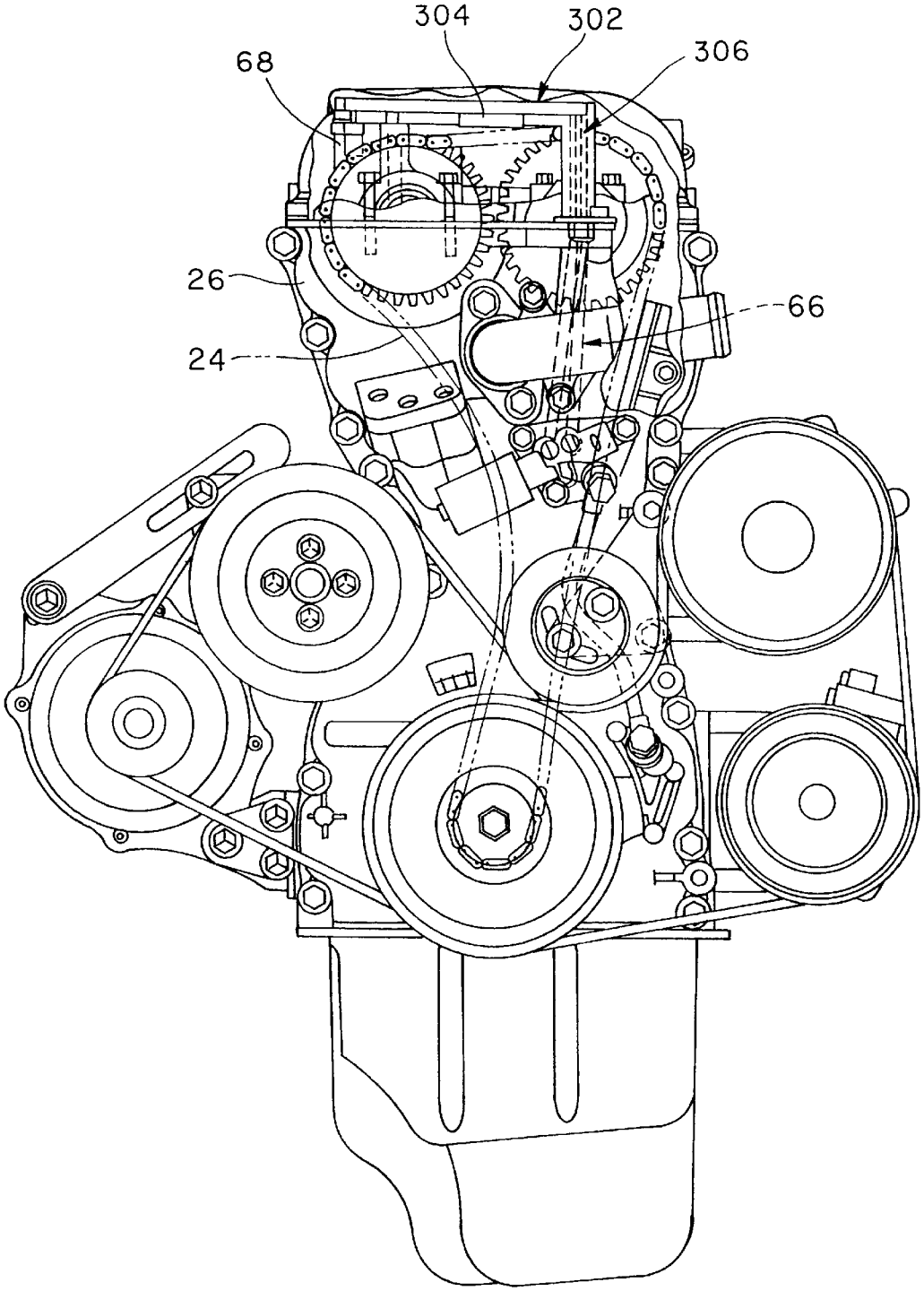
FIG. 33 is a front view illustrating an internal combustion engine with part of a timing case broken away according to another aspect of the first embodiment.
Figure 34:
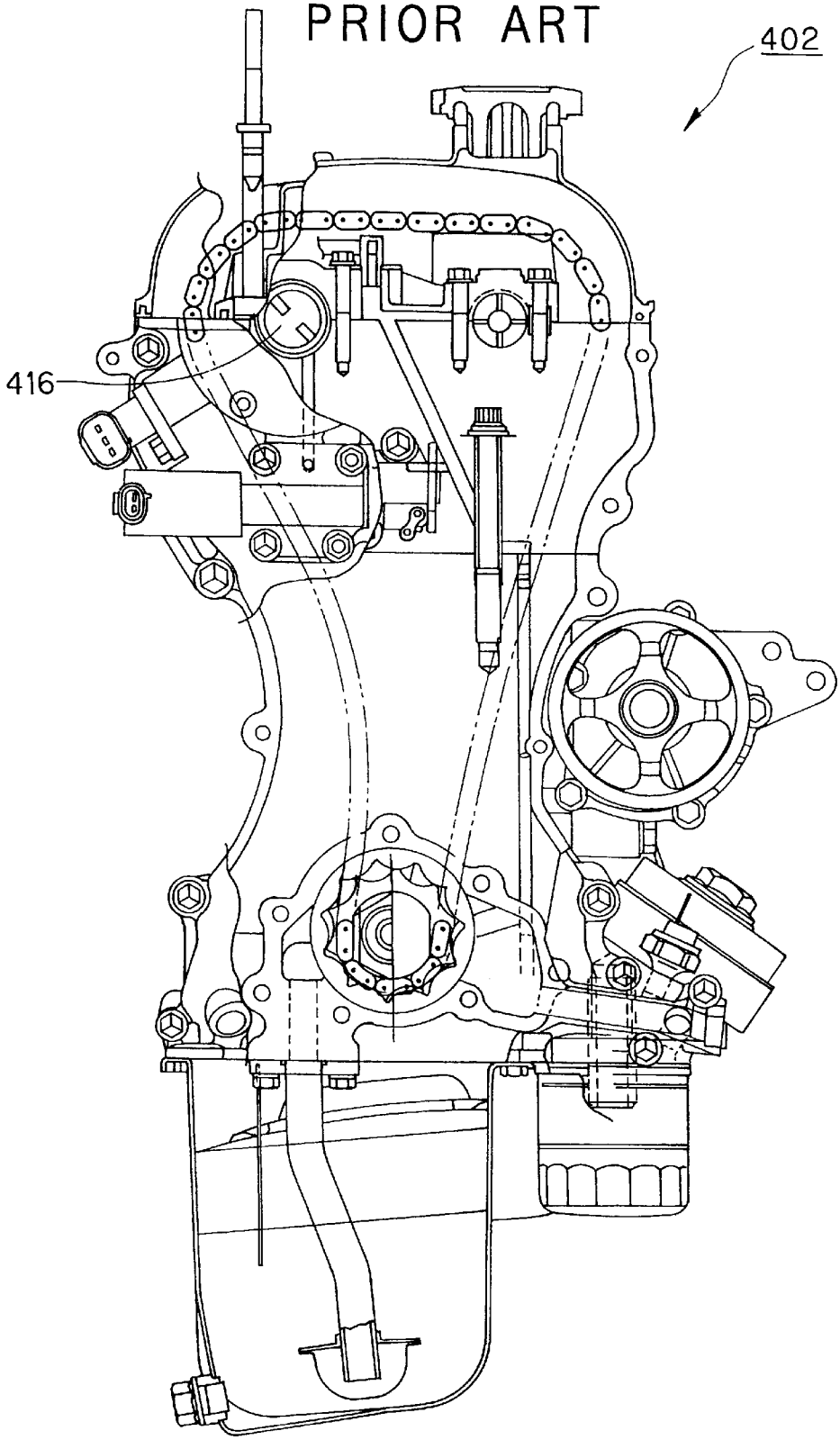
FIG. 34 PRIOR ART
FIG. 34 is a schematic front view showing an internal combustion engine according to the prior art.
Figure 35:
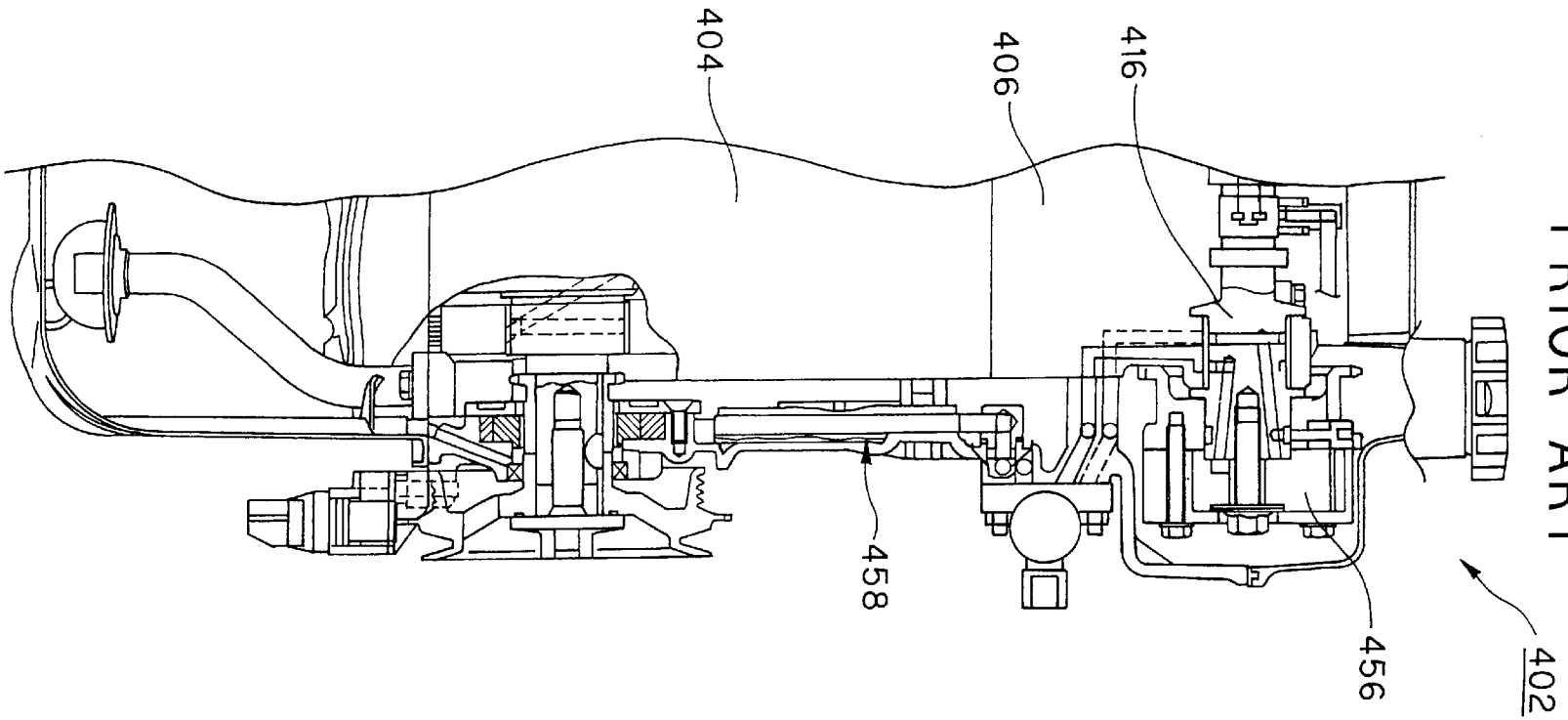
FIG. 35 PRIOR ART
FIG. 35 is a schematic cross-sectional view showing an oil passage in the engine of FIG. 34.
Figure 36:
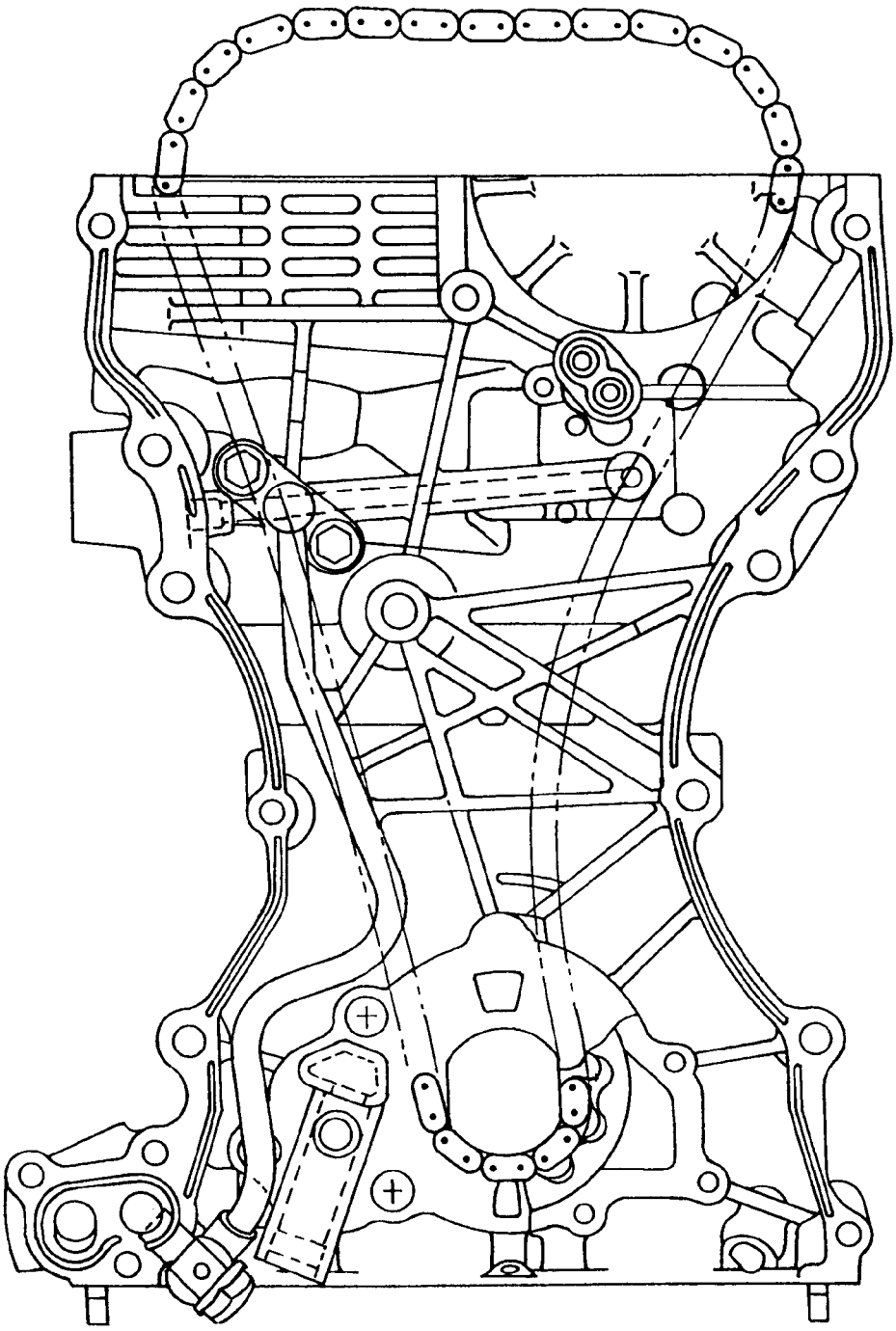
FIG. 36 PRIOR ART
FIG. 36 is a schematic front view illustrating a known timing cover.
Figure 37:
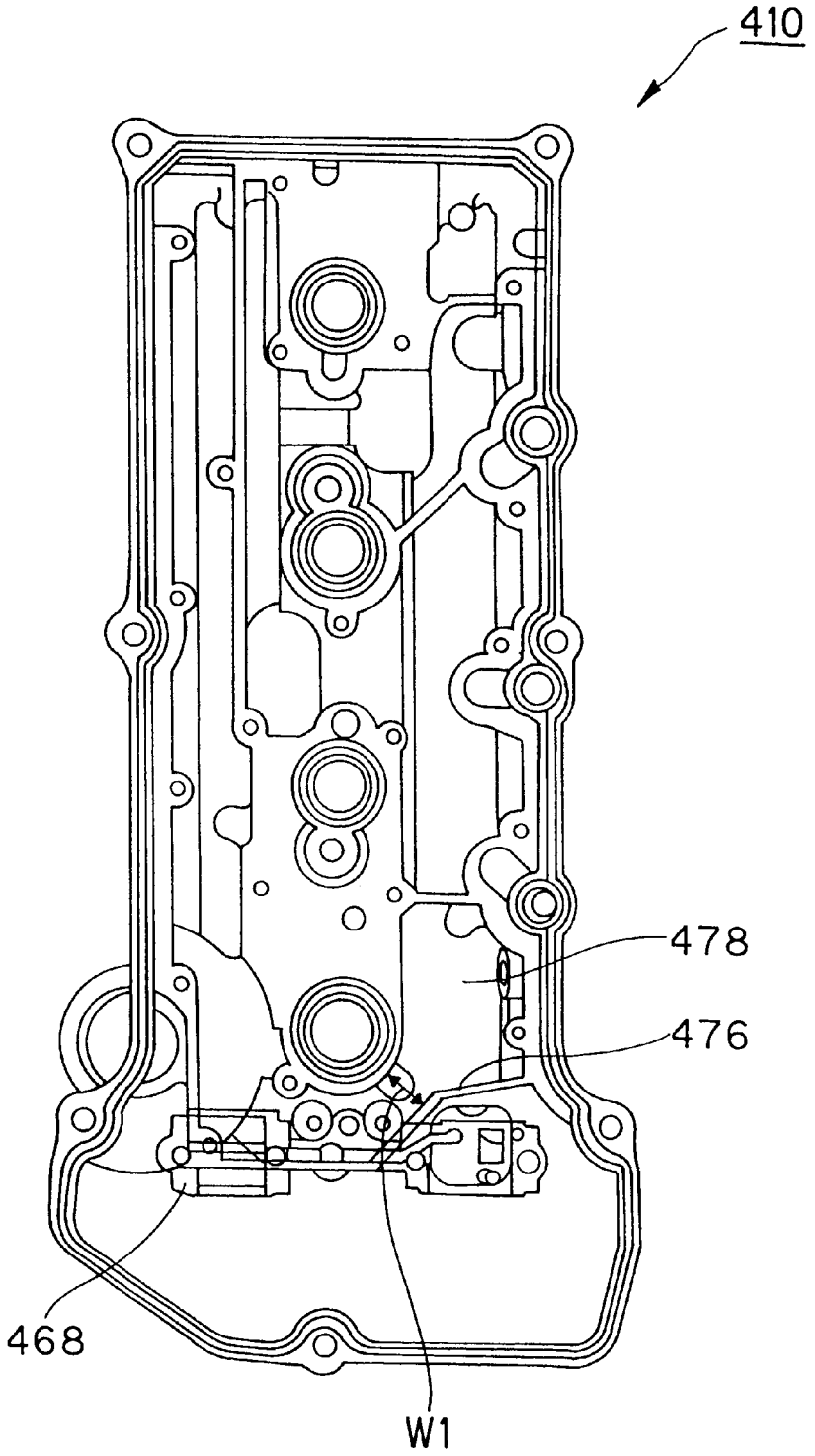
FIG. 37 PRIOR ART
FIG. 37 is a bottom view of FIG. 36 and illustrating a cylinder head cover.

More specifically, there is provided a L-shaped pipe body 302 (FIG. 33) positioned over the top of the timing chain 24. The pipe body 302 communicates the internal passage 66 of the timing case 26 with the cam housing 68. The pipe body 302 is formed integrally with the timing chain guide 304. In addition, a second oil passage 306 is formed in the pipe body 302. The second oil passage 306 includes advance-side and delay-side second oil passages (not shown).

The pipe body 302 is positioned over the top of the timing chain 24 at a position where the timing chain guide 304 is located. As a result, fewer components and lower cost are achievable, which is advantageous from an economical viewpoint. Further, the second oil passage 306 can be disposed directly above the timing chain guide 304. In addition, the second oil passage 306 and, in particular, the advance-side second oil passage can be reduced in length. Yet further, the variable valve timing actuator is operable for a reduced period of time. Moreover, even when the timing chain 24 is swung, there is no likelihood that the timing chain 24 bumps against the pipe body 302, thereby making it possible to positively prevent damages of the pipe body 302.

Pursuant to the first and second embodiments, the second oil pipe made of two pipes different in length or rather the advance-side and delay-side second oil pipes are positioned through the top or bottom of the timing chain. Alternatively, as a special structure, one of the second oil pipes, or only the advance-side second oil pipe, may be positioned through the bottom of the timing chain.

Accordingly, the advance-side second oil pipe can be made still shorter in length. This contributes toward a reduction in working time of the actuator.

As evidenced by the above description, the present invention provides an oil passage for an internal combustion engine, having a cylinder head attached to the top of a cylinder block and an oil pan fitted to the bottom of the cylinder block, the oil passage supplying engine oil to lubricated sections by an oil pump pumping the engine oil up from the oil pan, the oil passage using the engine oil as drive pressure on a variable valve timing actuator, the actuator being disposed on one side of a camshaft, comprising: a timing chain entrained around a crank sprocket and a cam sprocket, the crank sprocket being mounted on a crankshaft of the engine, the cam sprocket being positioned on the camshaft; and, a timing case disposed on one side of the engine for enclosing the timing chain; wherein the oil passage for supplying the engine oil to the actuator is connected at an upstream side thereof to a downstream side of the oil pump, while a downstream side of the oil passage is positioned inside the timing case and around the cam sprocket. Thus, the oil passage is not provided in components produced by large-scaled facilities such as the cylinder block or cylinder head, but is provided using those fabricated by small-scaled facilities or small-sized components such as the timing case, the cam housing, the pipes, and the like. Accordingly, manufacturing facilities can be changed at small costs when the existing internal combustion engine is utilized so as to accommodate in technical specifications of the actuator. As a result, a low cost internal combustion engine designed for the actuator is achievable. Thus, a reduction in cost can be realized, which is advantageous from an economical viewpoint.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An oil passage for an internal combustion engine having a cylinder head attached to the top of a cylinder block and an oil pan fitted to the bottom of the cylinder block, the oil passage supplying engine oil to lubricated sections by an oil pump pumping the engine oil up from the oil pan, the oil passage using the engine oil as drive pressure on a variable valve timing actuator, the actuator being disposed on one side of a camshaft, comprising: a timing chain entrained around a crank sprocket and a cam sprocket, the crank sprocket being mounted on a crankshaft of the engine, the cam sprocket being positioned on the camshaft; and a timing case disposed on one side of the engine for enclosing the timing chain; wherein the oil passage for supplying the engine oil to the actuator is connected at an upstream side thereof to a downstream side of the oil pump, while a downstream side of the oil passage is positioned inside the timing case and around the cam sprocket, wherein the oil passage includes a first oil pipe, an internal passage, and a second oil pipe, the first oil pipe communicating a main oil gallery with an oil control valve, the oil control valve being attached to the engine on one side thereof, the internal passage being communicated to the oil control valve and being formed inside the timing case, the second oil pipe communicating the internal passage with a cam housing, and wherein the second oil pipe is mounted on the cam housing at a position offset outward from the engine in a transverse direction of the engine with reference to an intake-side camshaft.

2. An oil passage for an internal combustion engine having a cylinder head attached to the top of a cylinder block and an oil pan fitted to the bottom of the cylinder block, the oil passage supplying engine oil to lubricated sections by an oil pump pumping the engine oil up from the oil pan, the oil passage using the engine oil as drive pressure for a variable valve timing actuator disposed on one side of a camshaft, comprising: a timing chain entrained around a crank sprocket and a cam sprocket, the crank sprocket being mounted on a crankshaft of the engine, the cam sprocket being positioned on the camshaft; and, a timing case disposed on one side of the engine for enclosing the timing chain; wherein the oil passage for supplying the engine oil to the actuator includes a first oil pipe, an internal passage, and a second oil pipe, the first oil pipe communicating a main oil gallery with an oil control valve and being disposed along the outside of the timing case, the oil control valve being attached to the engine on one side thereof, the internal passage communicating with the oil control valve and being formed inside the timing case, the second oil pipe communicating the internal passage with a cam housing to supply oil to the variable valve timing actuator and being mounted on the cam housing at a position offset outward from the engine in a transverse direction thereof with reference to an intake-side camshaft.

3. An oil passage for an internal combustion engine as defined in claim 2, wherein the second oil pipe is positioned inside the timing case and over the timing chain.

4. An oil passage for an internal combustion engine as defined in claim 2, wherein the second oil pipe includes two pipes different in length, in which the shorter pipe functions as an advance-side oil passage that leads to the actuator, and wherein a plurality of oil grooves are provided between the camshaft and the cam housing, some of the oil grooves located toward the cam sprocket serving as the advance-side oil passages that lead to the actuator.

5. An oil passage for an internal combustion engine as defined in claim 2, wherein the second oil pipe is positioned through a void space portion formed by the timing chain, the intake-side camshaft, and an exhaust-side camshaft.

6. An oil passage for an internal combustion engine as defined in claim 3, wherein the second oil pipe is integrally formed with a timing chain guide for the timing chain.

7. An oil passage for an internal combustion engine as defined in claim 2, wherein the second oil pipe includes two pipes different in length and defining advance-side and delay-side second oil pipes, the advance-side second oil pipe being positioned over the timing chain generally along a center-line of the intake-side camshaft and the delay-side second oil pipe extending over the timing chain at a position shifted outward from the center-line, the timing chain being wrapped around the cam sprocket.

* * * * *